US010025228B2

(12) United States Patent
Sakaya et al.

(10) Patent No.: US 10,025,228 B2
(45) Date of Patent: Jul. 17, 2018

(54) COLLECTING MEMBER TO COLLECT IMAGE FORMING POWDER

(71) Applicants: Kohta Sakaya, Tokyo (JP); Shinichi Arasawa, Hyogo (JP)

(72) Inventors: Kohta Sakaya, Tokyo (JP); Shinichi Arasawa, Hyogo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/500,586

(22) PCT Filed: Aug. 17, 2015

(86) PCT No.: PCT/JP2015/004061
§ 371 (c)(1),
(2) Date: Jan. 31, 2017

(87) PCT Pub. No.: WO2016/056163
PCT Pub. Date: Apr. 14, 2016

(65) Prior Publication Data

US 2017/0219965 A1 Aug. 3, 2017

(30) Foreign Application Priority Data

Oct. 9, 2014 (JP) ..... 2014-208010

(51) Int. Cl.
*G03G 15/08* (2006.01)
*G03G 15/095* (2006.01)

(52) U.S. Cl.
CPC ..... *G03G 15/095* (2013.01); *G03G 15/0886* (2013.01)

(58) Field of Classification Search
CPC ..... G03G 15/095; G03G 15/0886
USPC ..... 399/98, 258, 260
See application file for complete search history.

(56) References Cited

U.S. PATENT DOCUMENTS 7,450,890 B2 11/2008 Murakami et al.
8,478,162 B2 7/2013 Arasawa
8,526,849 B2 9/2013 Yoshida et al.
8,594,539 B2 * 11/2013 Sakai ..... G03G 15/0886 399/258

(Continued)

FOREIGN PATENT DOCUMENTS

JP H03-179385 8/1991
JP H06-130867 5/1994

(Continued)

OTHER PUBLICATIONS

Extended European Search Report dated Sep. 8, 2017 in Patent Application No. 15849032.6.

(Continued)

*Primary Examiner* — William J Royer
(74) *Attorney, Agent, or Firm* — Oblon, McClelland, Maier & Neustadt, L.L.P.

(57) ABSTRACT

A unit includes a part that is detachably attachable relative to an other unit, wherein the other unit includes an opening through which image forming powder is supplied from or received by the other unit, and a shutter that opens and closes the opening, and a collecting member that collects the image forming powder falling from at least one of the opening and the shutter by making contact with the shutter when detaching the unit from the other unit.

20 Claims, 21 Drawing Sheets

(56) References Cited

U.S. PATENT DOCUMENTS

| | | | | |
|---|---|---|---|---|
| 8,630,559 | B2 * | 1/2014 | Hasebe | G03G 15/0879 399/258 |
| 8,744,321 | B2 | 6/2014 | Kubota et al. | |
| 8,768,203 | B2 | 7/2014 | Hamada et al. | |
| 8,792,808 | B2 | 7/2014 | Kubota et al. | |
| 8,843,005 | B2 | 9/2014 | Yoshida et al. | |
| 2007/0248384 | A1 | 10/2007 | Kawai | |
| 2008/0050158 | A1 | 2/2008 | Hatayama et al. | |
| 2012/0099901 | A1 | 4/2012 | Sakai | |
| 2014/0147166 | A1 | 5/2014 | Nakamura et al. | |
| 2015/0003848 | A1 | 1/2015 | Sakaya | |
| 2016/0109827 | A1 | 4/2016 | Yoshida et al. | |

FOREIGN PATENT DOCUMENTS

| | | |
|---|---|---|
| JP | H09-274352 | 10/1997 |
| JP | 2006-163374 | 6/2006 |
| JP | 2007-293035 | 11/2007 |
| JP | 2008-051948 | 3/2008 |
| JP | 2015-014720 | 1/2015 |
| JP | 2015-118269 | 6/2015 |

OTHER PUBLICATIONS

International Search Report dated Oct. 20, 2015 in PCT/JP2015/004061 filed on Aug. 17, 2015.

* cited by examiner

[Fig. 1]
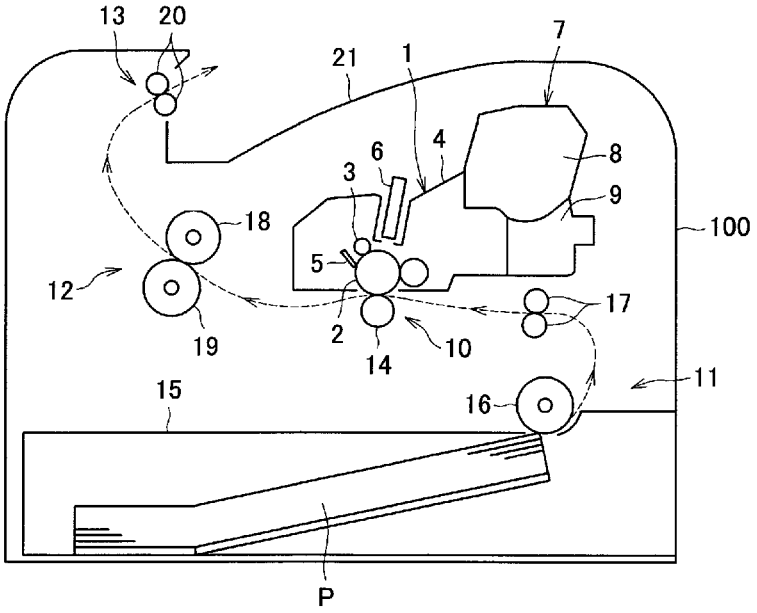
[Fig. 2]
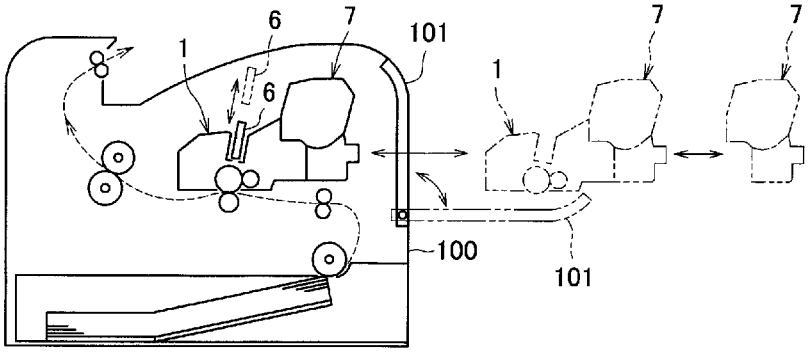

[Fig. 3]
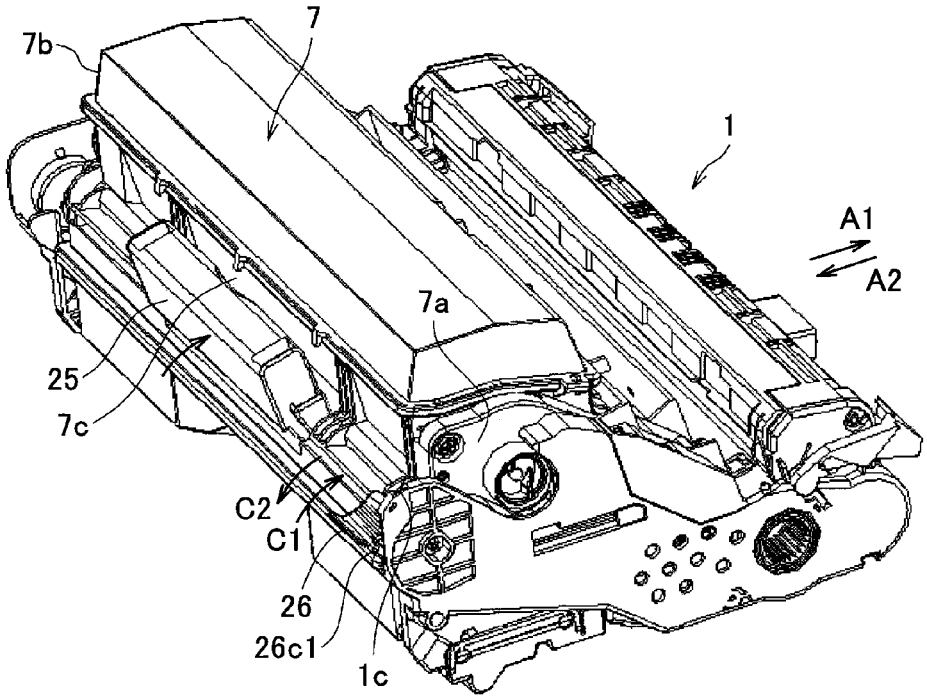

[Fig. 4]
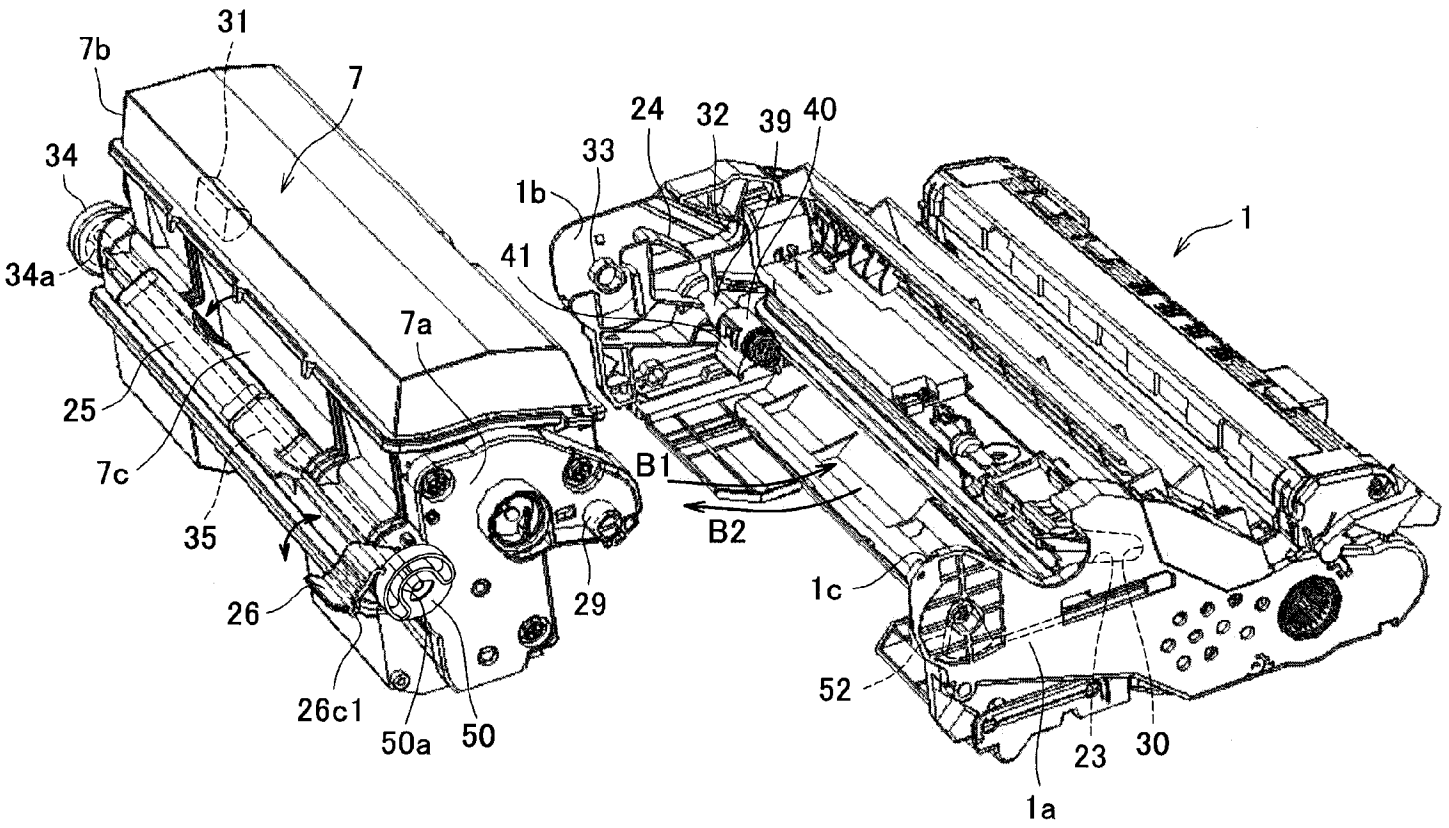

[Fig. 5]
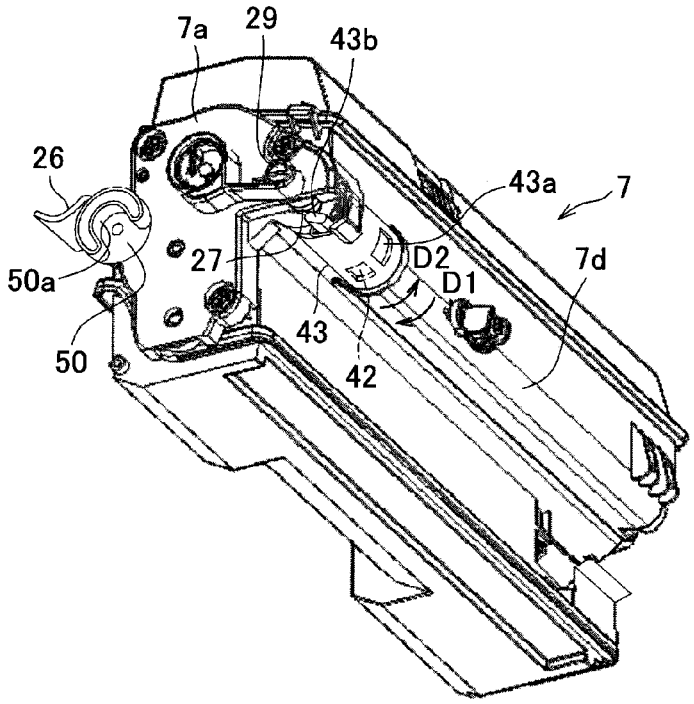
[Fig. 6]
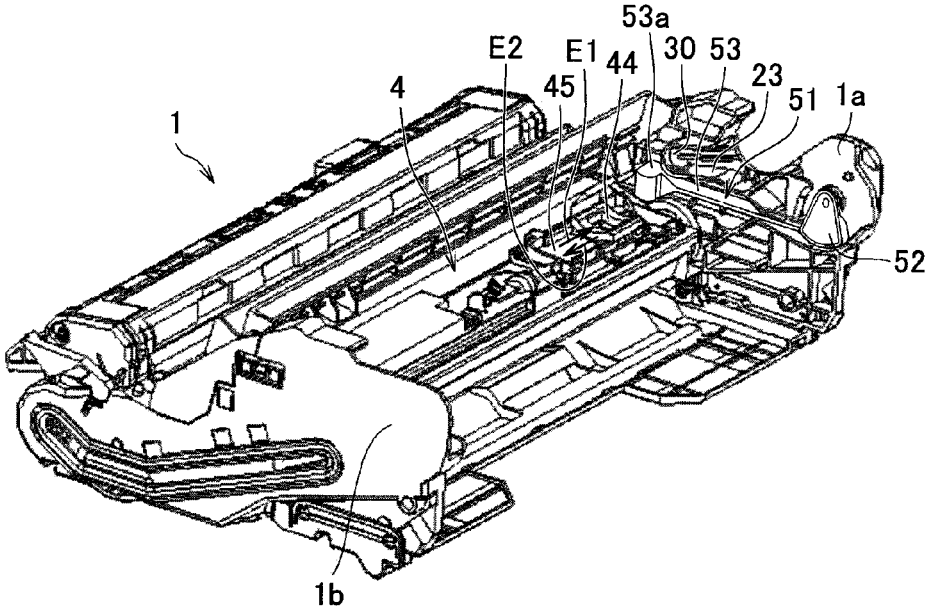

[Fig. 7]
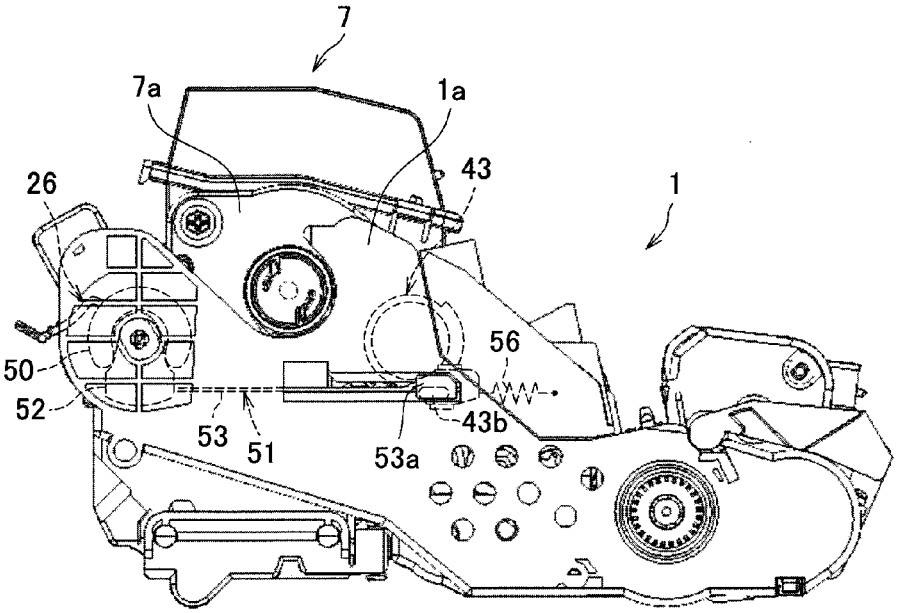
[Fig. 8]
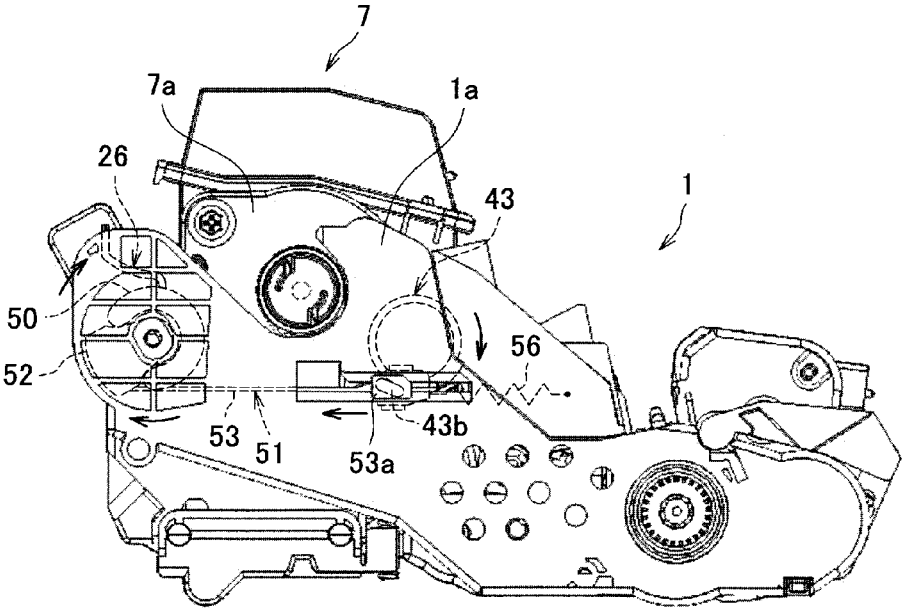

[Fig. 9]
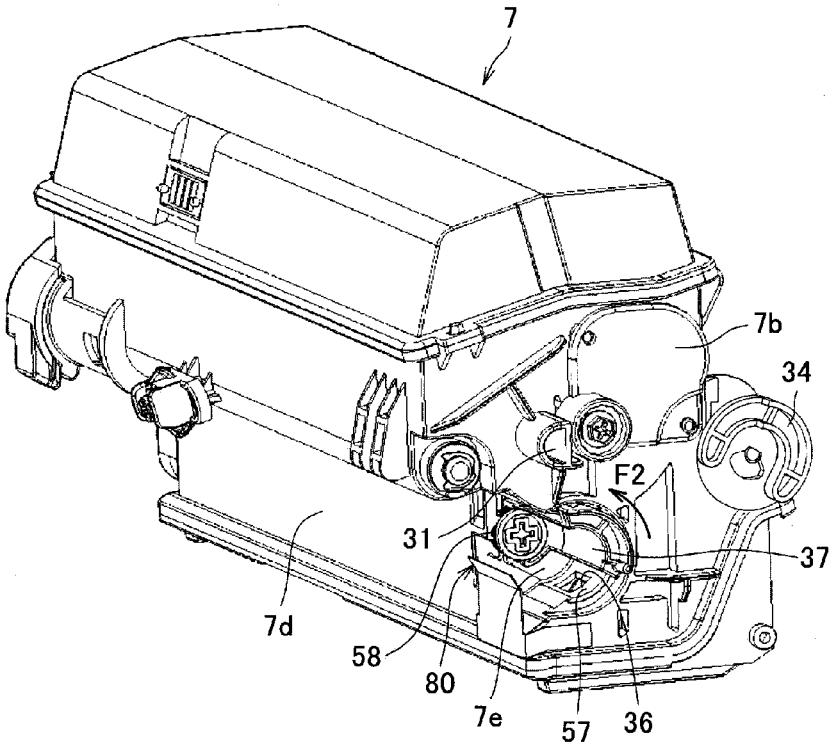

[Fig. 10]
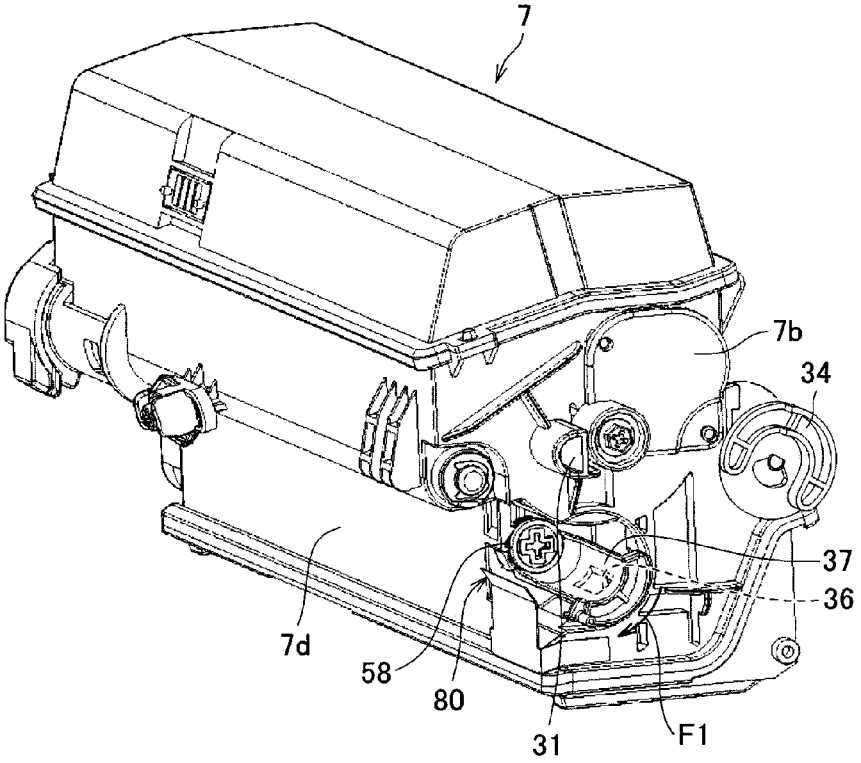

[Fig. 11]
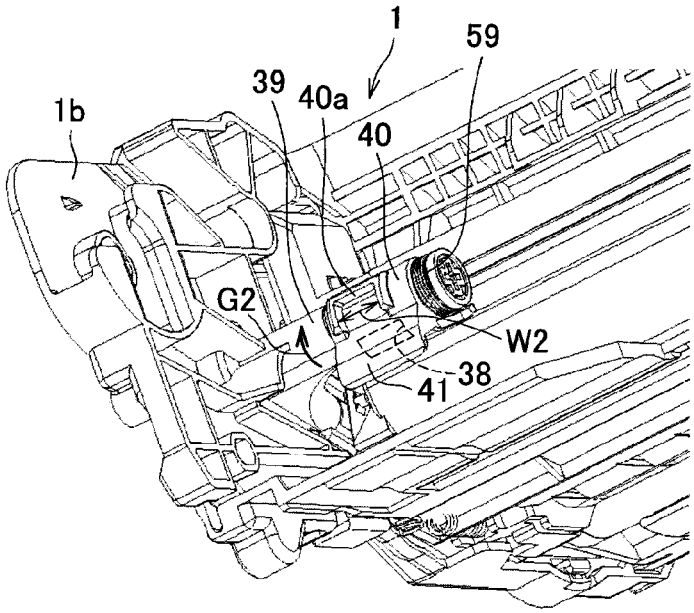
[Fig. 12]
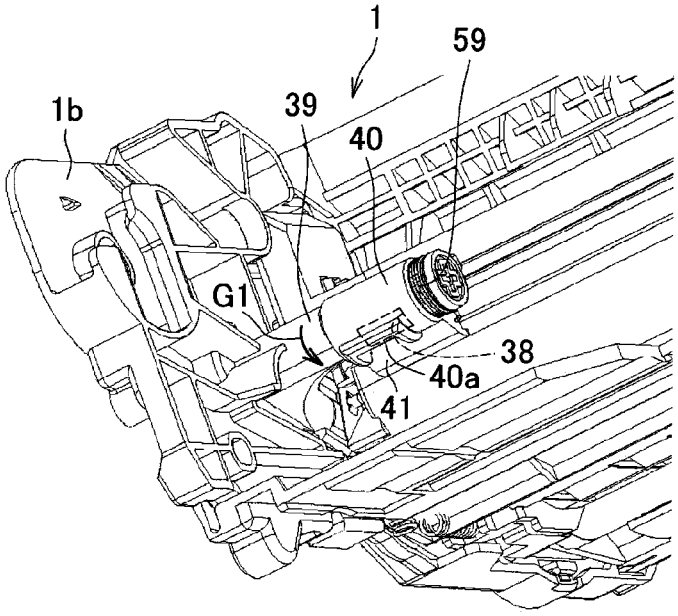

[Fig. 13]
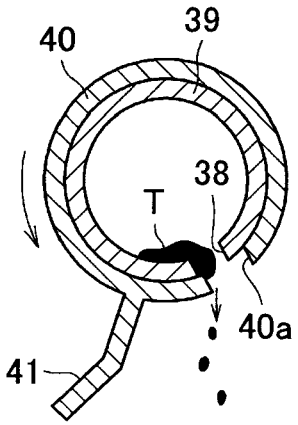
[Fig. 14]
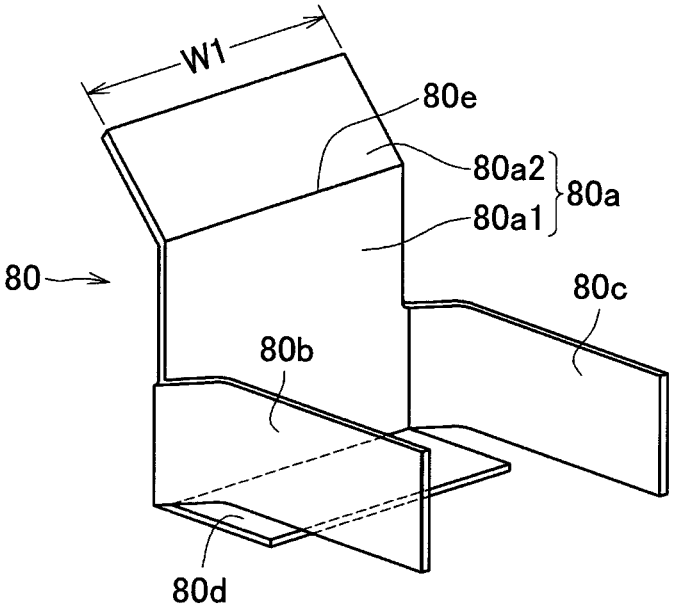

[Fig. 15]
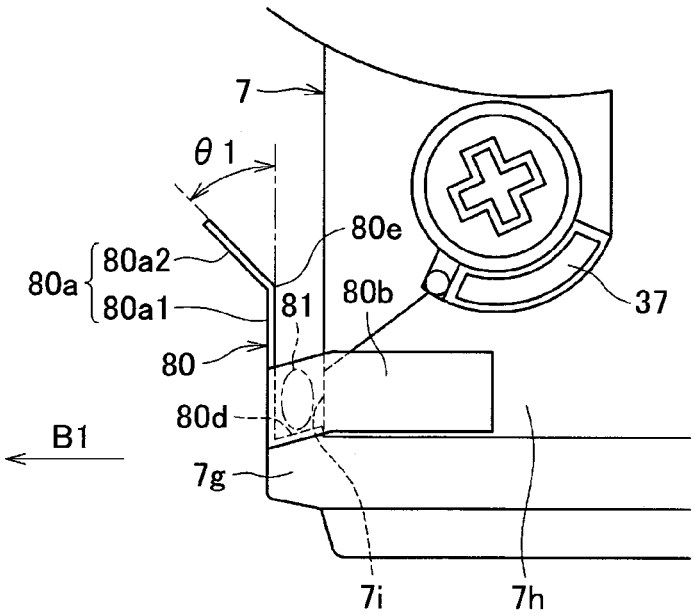
[Fig. 16]
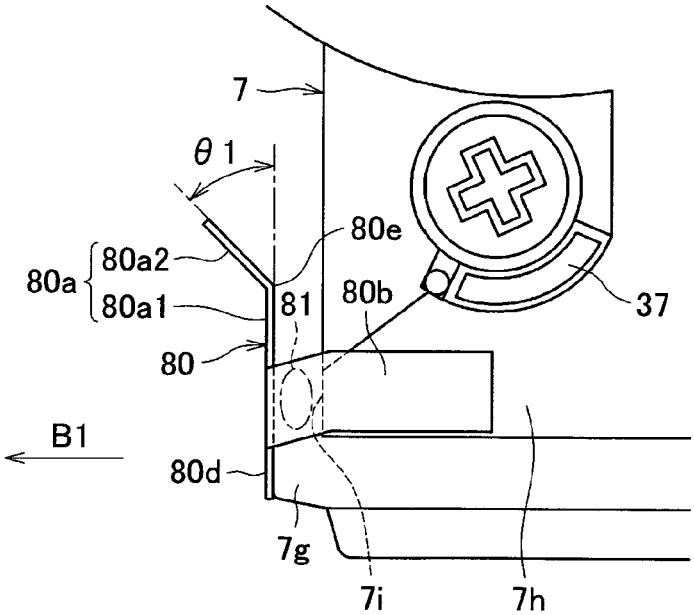

[Fig. 17A]
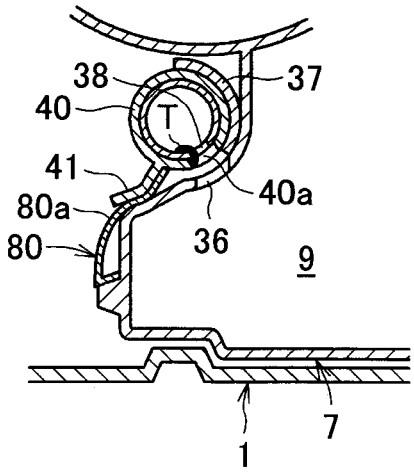
[Fig. 17B]
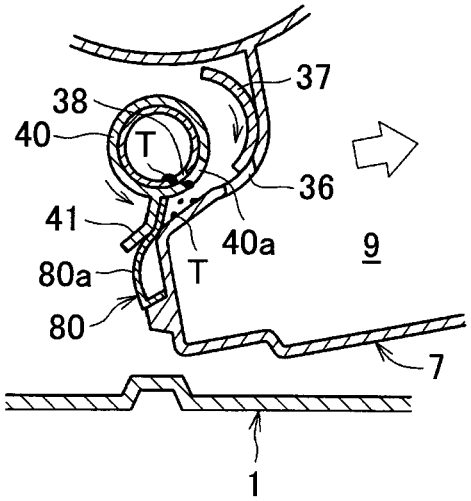

[Fig. 17C]
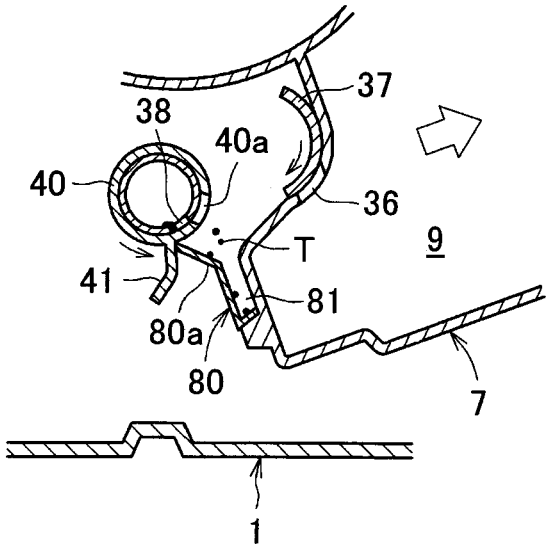
[Fig. 17D]
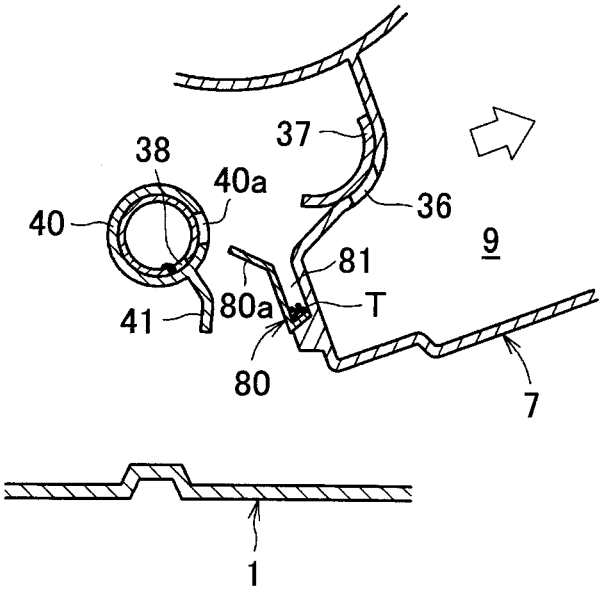

[Fig. 18A]
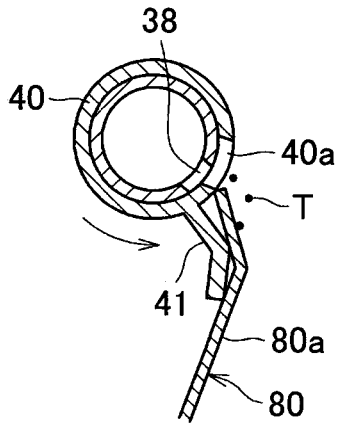
[Fig. 18B]
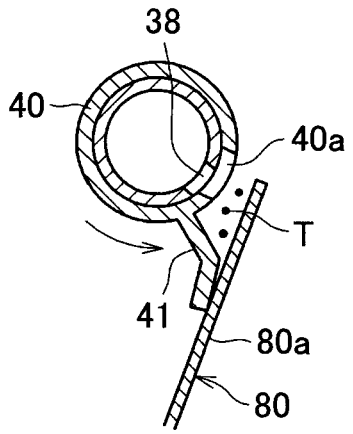

[Fig. 19]
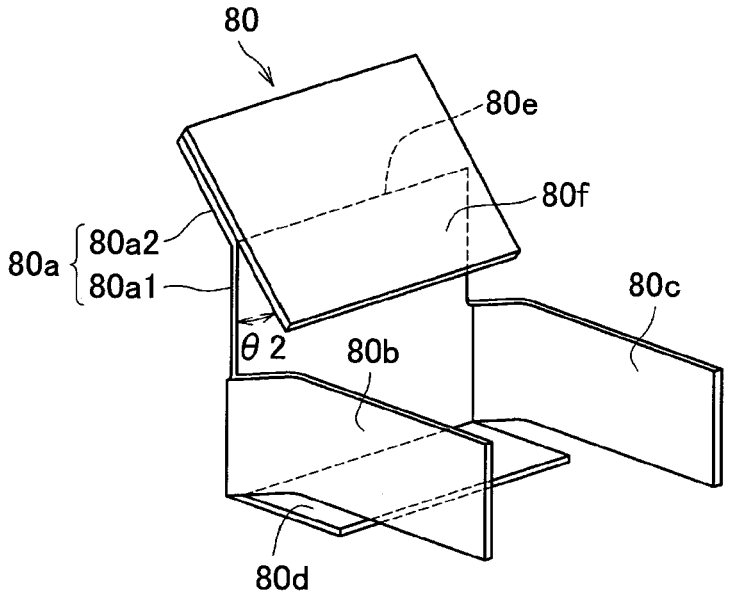
[Fig. 20]
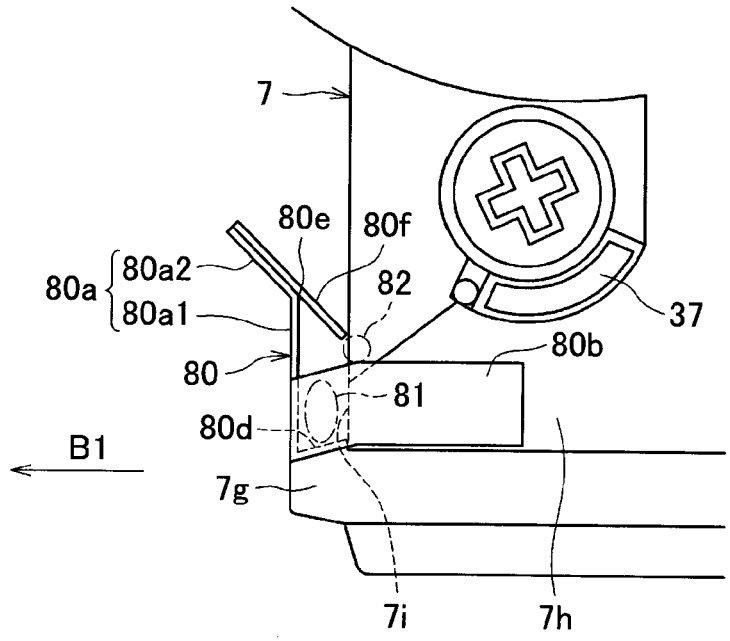

[Fig. 21]
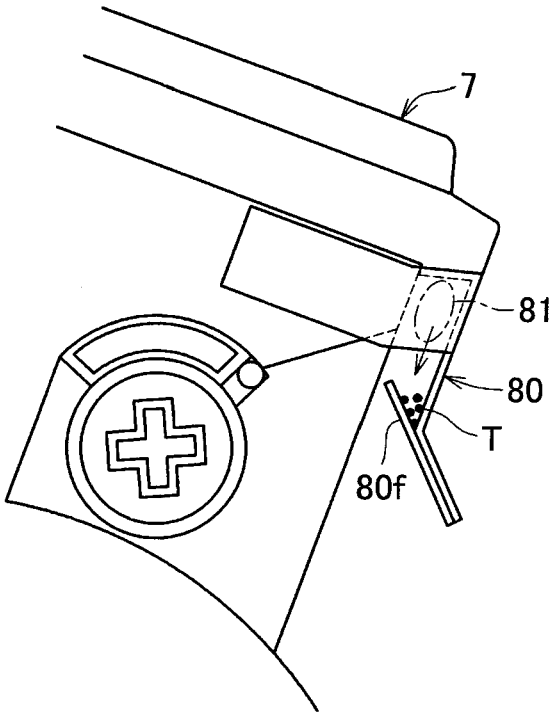
[Fig. 22A]
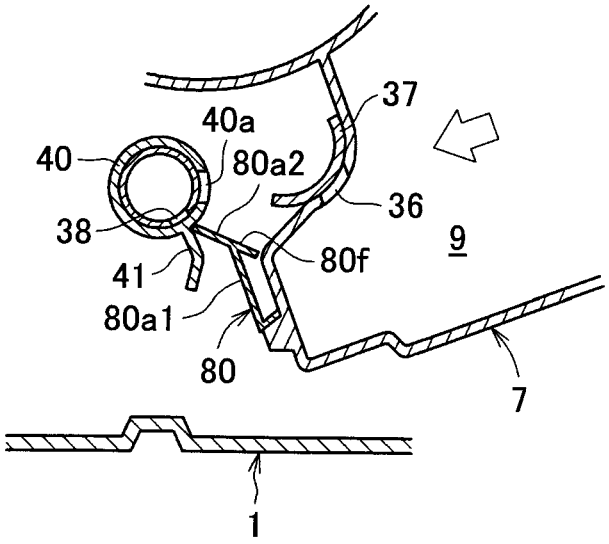

[Fig. 22B]
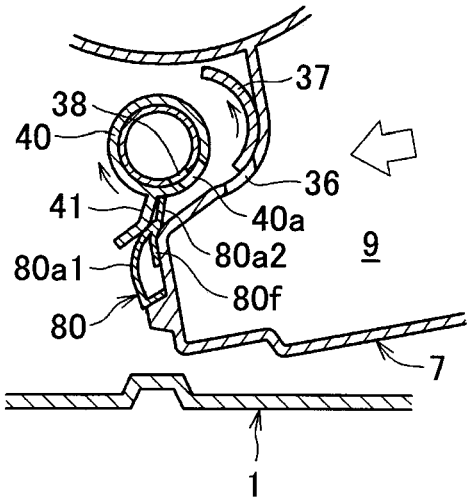
[Fig. 22C]
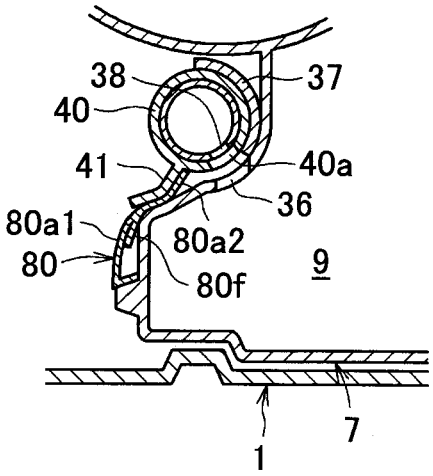

[Fig. 23]
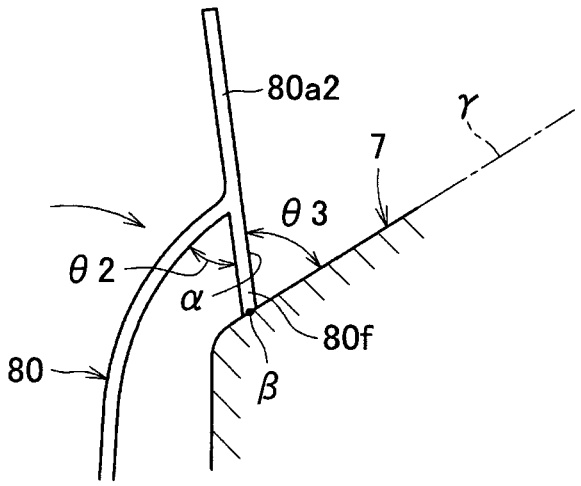
[Fig. 24]
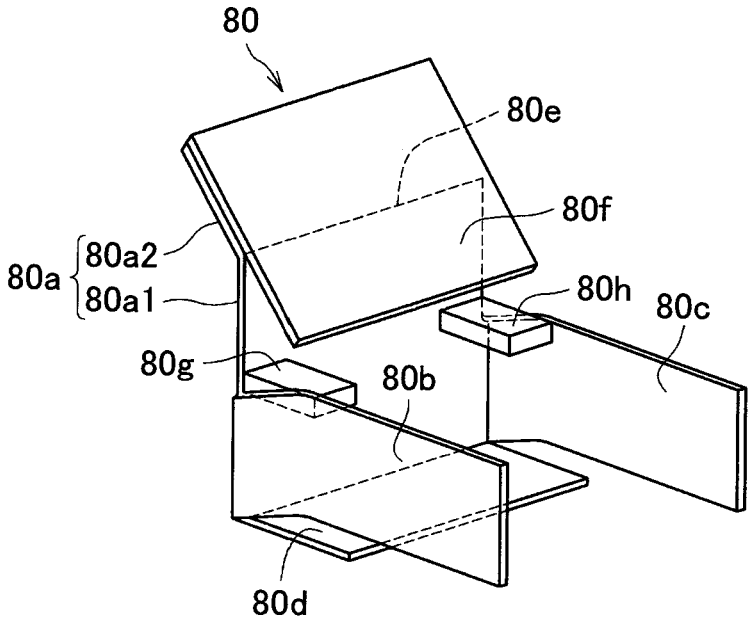

[Fig. 25]
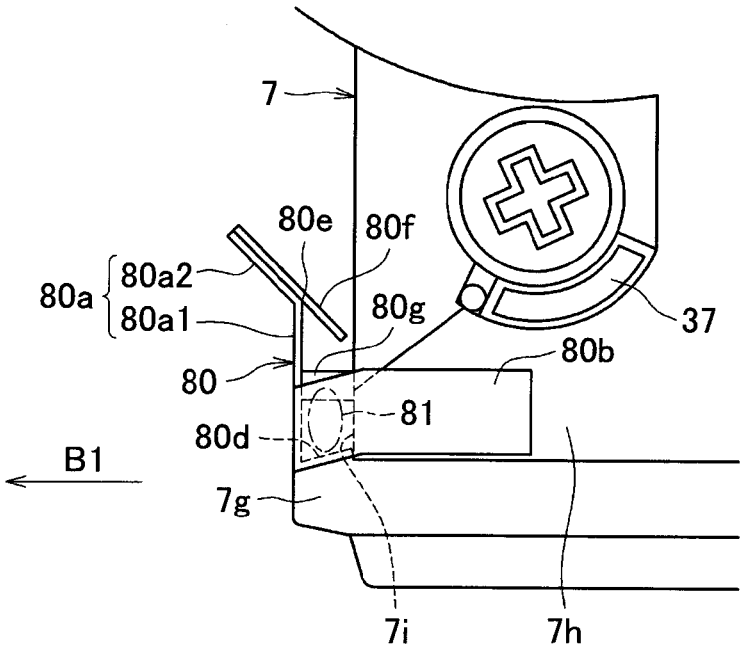
[Fig. 26]
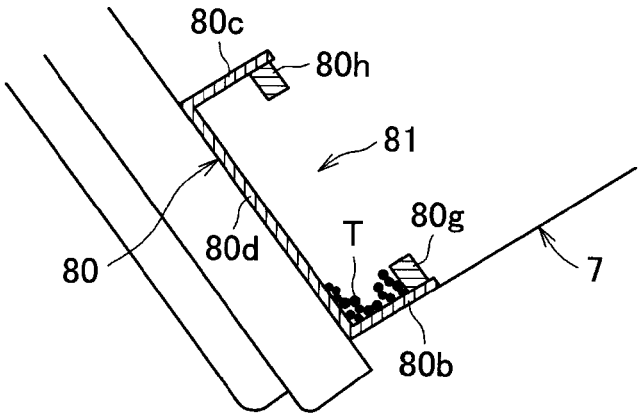

[Fig. 27]
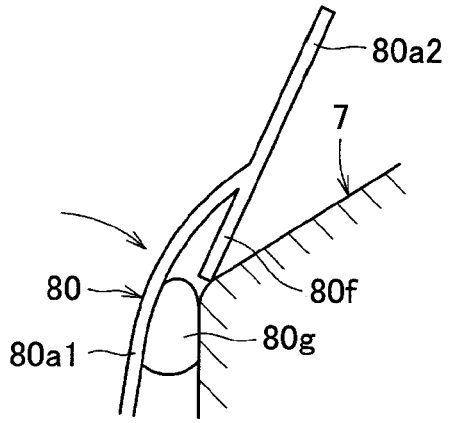
[Fig. 28]
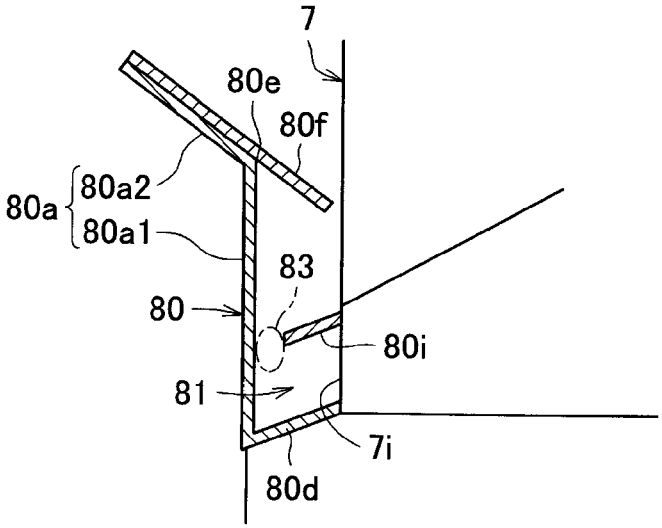

[Fig. 29]
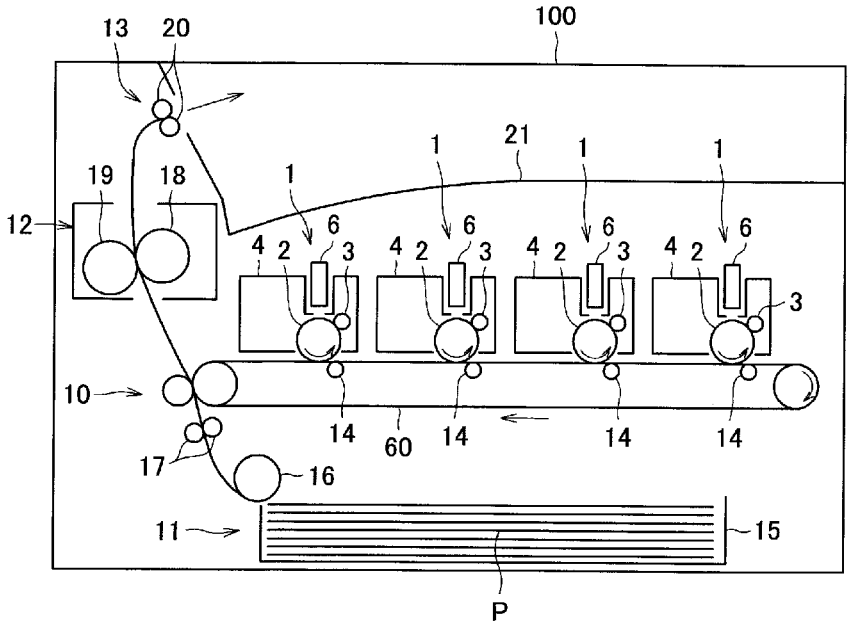

[Fig. 30]
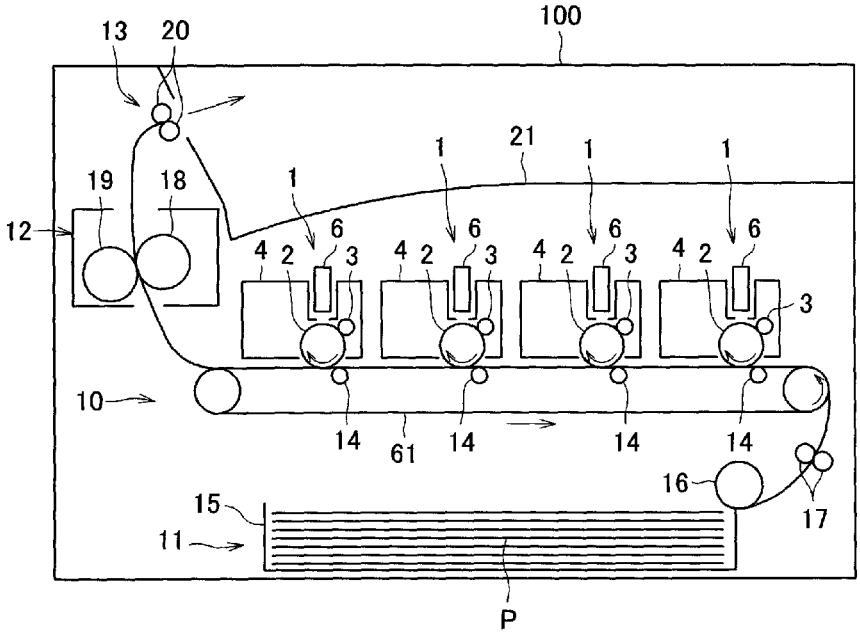

COLLECTING MEMBER TO COLLECT IMAGE FORMING POWDER

FIELD

The present invention relates to a unit that is attachable and detachable relative to an other unit, and to an image forming apparatus having such a unit.

BACKGROUND

An image forming apparatus such as a copying apparatus, a printer, a facsimile apparatus, an MFP (Multi-Function Peripheral), or the like, often employs a system in which a part for accommodating a toner that is an example of image forming powder is provided in a form of a unit that can be attached (or loaded) and detached (or unloaded) with respect to a base unit or the like of the image forming apparatus.

According to this system, when the unit accommodating the toner is attached to the other unit, openings provided in the two units are connected so that the toner can be exchanged through the two openings. On the other hand, in a state in which the two units are detached from each other, the connection of the openings of the two units is released, and it is desirable to prevent the toner from leaking from the openings. For this reason, in general, a shutter is provided to close each of the openings, as proposed in PTL 1 (Japanese Laid-Open Patent Publication No. 9-274352), for example.

CITATION LIST

Patent Literature

PTL 1 Japanese Laid-Open Patent Publication No. 9-274352

SUMMARY

Technical Problem

As described above, by providing the shutter that closes the opening, it is possible to prevent the toner from leaking through the opening after the shutter is closed. However, when detaching the two units, the toner adhered at the opening or in a vicinity of the opening may be scraped off by the shutter as the shutter closes, to thereby cause the toner that is scraped off to fall. In addition, the toner adhered at the opening or in the vicinity of the opening may fall due to vibrations or the like when the two units are detached from each other. When the toner falls onto various devices within the image forming apparatus, the devices and peripheries of the devices may be contaminated by the toner, and cause an abnormality in functions of the devices.

Solution to Problem

In order to solve the problem described above, a unit according to one embodiment includes a part that is detachably attachable relative to an other unit, wherein the other unit includes an opening through which image forming powder is supplied from or received by the other unit, and a shutter configured to open and close the opening; and a collecting member configured to collect the image forming powder falling from at least one of the opening and the shutter by making contact with the shutter when detaching the unit from the other unit.

Advantageous Effects of Invention

According to the present invention, when detaching the unit from the other unit, a collecting member makes contact with a shutter and collects the powder falling from the opening or the shutter. Hence, it is possible to prevent the falling powder from adhering to the devices or the peripheries of the devices.

BRIEF DESCRIPTION OF DRAWINGS

FIG. 1
Diagram schematically illustrating a configuration of an example of an image forming apparatus in one embodiment of the present invention.

FIG. 2
Diagram for explaining a method of attaching and detaching a process unit and a toner cartridge.

FIG. 3
Perspective view of a state in which the toner cartridge and the process unit are attached to each other.

FIG. 4
Perspective view of a state in which the toner cartridge and the process unit are detached from each other.

FIG. 5
Perspective view viewed from a lower right direction of the toner cartridge.

FIG. 6
perspective view viewed from an upper left direction of the process unit.

FIG. 7
Diagram for explaining opening and closing operations of an outlet shutter for toner.

FIG. 8
Diagram for explaining the opening and closing operations of the outlet shutter for toner.

FIG. 9
Perspective view viewed from a left side of the toner cartridge.

FIG. 10
Perspective view viewed from the left side of the toner cartridge.

FIG. 11
Perspective view viewed from an inner side of a left plate of the process unit.

FIG. 12
Perspective view viewed from the inner side of the left plate of the process unit.

FIG. 13
Diagram illustrating state in which a toner scraped off by an outlet shutter that rotates falls.

FIG. 14
Perspective view of a collecting member in a first embodiment of the present invention.

FIG. 15
Side view of a state in which the collecting member in the first embodiment of the present invention is mounted on the toner cartridge.

FIG. 16
Diagram illustrating another method of mounting the collecting member.

FIG. 17A
Diagram for explaining functions and effects of the collecting member in the first embodiment.

FIG. 17B
Diagram for explaining the functions and the effects the collecting member in the first embodiment.

FIG. 17C
Diagram for explaining the functions and the effects of the collecting member in the first embodiment.

FIG. 17D

Diagram for explaining the functions and the effects of the collecting member in the first embodiment.

FIG. 18A

Diagram comparing a configuration in which the collecting member is curved and a configuration in which the collecting member is not curved and is linearly formed.

FIG. 18B

Diagram comparing the configuration in which the collecting member is curved and the configuration in which the collecting member is not curved and is linearly formed.

FIG. 19

Perspective view of the collecting member in a second embodiment of the present invention.

FIG. 20

Side view of a state in which the collecting member in the second embodiment is mounted on the toner cartridge.

FIG. 21

Diagram illustrating a state in which the toner cartridge is upside-down.

FIG. 22A

Diagram illustrating a state in which a restricting part undergoes a resilient deformation When attaching the toner cartridge to the process unit.

FIG. 22B Diagram illustrating the state in which the restricting part under-goes the resilient deformation when at aching the toner cartridge to the process unit.

Diagram illustrating the state in which the restricting part undergoes the resilient deformation when attaching the toner cartridge to the process unit.

FIG. 23

Diagram illustrating an angle at which a tip end of the restriction part makes contact with housing of the toner cartridge.

FIG. 24

Perspective view of the collecting member in a third embodiment of the present invention.

FIG. 25

Side view of a state which the collecting member in the third embodiment of the present invention.

FIG. 26 Diagram illustrating a state in which the toner cartridge is tilted in one of right and left directions.

Diagram illustrating a state in which second restricting parts undergo a compressive deformation when attaching the toner cartridge to the process unit.

FIG. 28

Diagram illustrating a configuration of a fourth embodiment of the present invention.

FIG. 29

Diagram schematically illustrating a configuration of a color image forming apparatus employing an indirect transfer system.

FIG. 30

Diagram schematically illustrating configuration of a color image forming apparatus employing a direct transfer system.

DESCRIPTION OF EMBODIMENTS

A description will be given of embodiments of the present invention, by referring to the drawings. In the figures used to describe the embodiments, those constituent parts or constituent elements that have the same function or the same shape are designated by the same reference numerals, as long as the constituent parts or elements are distinguishable. For the sake of convenience, a description of the constituent parts or elements that have the same function or shape will not be repeated.

EXAMPLES

FIG. 1 is a diagram schematically illustrating a configuration of an example of an image forming apparatus in one embodiment of the present invention. First, a description will be given of a general configuration and operation of the image forming apparatus, by referring to FIG. 1.

The image forming apparatus illustrated in FIG. 1 is a monochrome image forming apparatus. A process unit 1 that is an example of an image forming unit (or image forming device) is detachably attached to an apparatus body (or image forming) apparatus body) 100. The process unit 1 includes a photoconductor 2 that is an example of an image carrier for carrying an image on a surface thereof, a charging roller 3 that is an example of a charging unit (or means) to charge the surface of the photoconductor 2, a developing device 4 that is an example of a developing unit (or means) to develop and visualize a latent image on the photoconductor 2, a cleaning blade 5 that is an example of a cleaning unit (or means) to clean the surface of the photoconductor 2, or the like. In addition, an LED (Light Emitting Diode) head array 6 that is an example of an exposure unit (or means) to expose the surface of the photoconductor 2 is arranged at a position opposing the photoconductor 2.

A toner cartridge 7 that is an example of a toner container to accommodate a toner that is an example of an image forming powder is detachably attached to the process unit 1. The toner cartridge 7 includes a toner recovery part 8 to accommodate an unused toner, and a waste toner recovery part 9 to accommodate a waste toner.

In addition, the image forming apparatus includes a transfer device 10 that transfers an image onto a sheet, a sheet feeding device 11 to feed the sheet, a fixing device 12 to fix the image transferred onto the sheet, a sheet ejection device 13 to eject the sheet outside the image forming apparatus, and a pair of registration rollers 17 that is an example of timing rollers. The sheet is an example of a recording medium that will be described below.

The transfer unit 10 includes a transfer roller 14 that is an example of a transfer member. The transfer roller 14 is arranged to make contact with the photoconductor 2 in a state in which the process unit 1 is attached to the apparatus body 100. In addition, the transfer roller 14 is connected to a power supply to receive a predetermined DC (Direct Current) voltage and/or a predetermined AC (Alternating Current) voltage.

The sheet feeding device 11 includes a sheet feeding cassette 15 that accommodates sheets P, and a sheet feeding roller 16 that feeds, one by one, the sheet P accommodated within the sheet feeding cassette 15. The sheet P is not limited to plain paper, and may include thick paper, a postcard, an envelope, paper, coated paper, art paper, tracing paper, or the like. The sheet P may be an OHP (Over-Head Projector) sheet, an OHP films, or the like. In other words, the sheet P may be any type of recording medium capable carrying an image thereon.

The fixing device 12 includes a fixing roller 18 that is an example of a fixing member, and a pressing roller 19 that is an example of a pressing member. The fixing roller 18 is heated by a heating source such as a heater or the like. The pressing roller 19 is pressed towards the fixing roller 18, and forms a fixing nip at a contact part between the pressing roller 19 and the fixing roller 18.

The sheet ejection device 13 includes a pair of sheet ejection rollers 20 that ejects the sheet P outside the image forming apparatus. In addition, a sheet ejection tray 21 is arranged at an upper outer part of the apparatus body 100. The sheet P ejected by the sheet ejection rollers 20 is ejected onto the sheet ejection tray 21.

Next, a description will be given of an image forming operation of the image forming apparatus in the embodiment, by referring to FIG. 1.

When the image forming operation is started, the photoconductor 2 driven to rotate, and the surface of the photoconductor 2 is uniformly charged by the charging roller 3 to a predetermined polarity. Next, the LED head array 6 exposes the charged surface of the photoconductor 2, based on image information from a reading device, a computer, or the like, to, thereby form an electrostatic latent image on the photoconductor 2. Then, the developing device 4 supplies the toner on the electrostatic latent image on the photoconductor 2, in order to visualize the electrostatic latent image into a toner image.

In addition, when the image forming operation starts, the driving to rotate the sheet feeding roller 16 starts, and the sheet P is fed from the sheet feeding cassette 15. The sheet P that is fed is temporarily stopped from being transported by the pair of registration rollers 17. Thereafter, the driving to rotate the pair of registration rollers 17 starts at a predetermined timing, and the sheet P is transported to a transfer nip at a timing matching a timing at which the toner image on the photoconductor 2 reaches the transfer nip.

When the sheet P is transported to the transfer nip, the toner image on the photoconductor 2 is transferred onto the sheet P by a transfer field that is generated due to a predetermined voltage applied to the transfer roller 14. In addition, the toner on the photoconductor 2, that is not transferred onto the sheet P in this state, is removed by the cleaning blade 5 and is recovered into the waste toner recovery part 9.

The sheet P having the toner image transferred thereon is transported to the fixing device 12. The toner image on the sheet P is fixed as the sheet P passes the fixing nip formed between the fixing roller 18 and the pressing roller 19 and is heated and pressed. Further, the sheet P is ejected outside the image forming apparatus by the sheet ejection rollers 20, onto the sheet ejection tray 21.

FIG. 2 is a diagram for explaining a method of attaching and detaching the process unit 1 and the toner cartridge 7.

As illustrated in FIG. 2, a part of an exterior of the apparatus body 100 can be opened by opening a cover 101 provided on the apparatus body 100, as indicated by a two-dot chain line in FIG. 2. The process unit 1 and the toner cartridge 7 can be attached to and detached from each other through this open part. In addition, when the cover 101 is opened to an open state, the LED head array 6 moves upwards as indicated by a two-dot chain line in FIG. 2, in order to avoid interfering with the process unit 1 that is attached or detached with respect to the apparatus body 100. The process unit 1 and the toner cartridge 7 may be attached to or detached from the apparatus body 100 in a state in which the process unit 1 and the toner cartridge 7 are integrally assembled into one unit. Alternatively, the toner cartridge 7 by itself may be attached to and detached from the apparatus body 100 in a state in which the process unit 1 remains attached to the apparatus body 100.

FIG. 3 is a perspective view of a state in which the toner cartridge 7 and the process unit are attached (or connected) to each other, and FIG. 4 is a perspective view of a state in which the toner cartridge 7 and the process unit are detached (or separated) from each other.

In FIG. 3, an arrow A1 indicates an attaching direction (or loading direction) of the process unit 1 and the toner cartridge 7 with respect to the apparatus body 100, and an arrow A2 indicates a detaching direction (or unloading direction) of the process unit and the toner cartridge 7 with respect to the apparatus body 100. In FIG. 4, an arrow B1 indicates an attaching direction (or loading direction) the toner cartridge 7 with respect to the process unit 1, and an arrow B2 indicates a detaching direction (or unloading direction) of the toner cartridge 7 with respect to the process unit 1. In the following description related to the configurations of process unit 1 and the toner cartridge 7, the respective attaching directions may also be referred to as "front sides", and the respective detaching direction opposite to the respective attaching directions may also be referred to as "rear sides". In FIGS. 3 and 4, a front side relative to a paper surface (or outwards from the paper surface) may also be referred to as a "right side", and a back side relative to the paper surface (or inwards into the paper surface) may also be referred to as a "left side".

As illustrated in FIG. 4, a right sidewall 7*a* and a left sidewall 7*b* of the toner cartridge 7 are provided with positioning projections 29 and 31 for positioning the toner cartridge 7 with respect to the process unit 1. On the other hand, a right plate 1*a* and a left plate 1*b* of the process unit 1 are provided with guide grooves 23 and 24 that guide the positioning projections 29 and 31 when attaching the process unit 1 to the toner cartridge 7, and ends 30 and 32 of the guide grooves 23 and 24. The ends 30 and 32 have a stopper function to stop the positioning projections 29 and 31 when the attaching of the process unit 1 to the toner cartridge 7 is completed. In this example, the positioning projections 29 and 31 form an example of a part of the toner cartridge 7 that is detachably attachable relative to process unit 1.

In addition, the right sidewall 7*a* and the left sidewall 7*b* of the toner cartridge 7 are provided with fitting parts 34 and 50 that are used when an operator fixes the toner cartridge 7 with respect to the process unit 1. On the other hand, the right plate 1*a* and the left plate 1*b* of the process unit 1 are provided with a projecting part 33 and a rotary part 52 that fit into recesses 34*a* and 50*a* formed in the fitting parts 34 and 50 of the toner cartridge 7.

The fitting parts 34 and 50 are provided on respective ends of a shaft 35 that is rotatable around a shaft center, and are integrally operated to rotate by a lever 26 that is provided on the right side of the fitting part 50. When the lever 26 is operated to rotate in a direction of an arrow C1 in FIG. 3 in a state in which the recesses 34*a* and 50*a* of the fitting parts 34 and 50 are fitted over the projecting part 33 and the rotary part 52, separation of the fitting parts 34 and 50 from the projecting part 33 and the rotary part 50 becomes restricted. Further, in this state, a locking projection 26*c*1 provided on the lever 26 engages an engaging groove 1*c* provided in the right plate 1*a* of the process unit 1, to also restrict rotation of the lever 26. On the other hand, when the lever 26 is operated to rotate in a direction of an arrow C2 in FIG. 3 to release the engagement between the locking projection 26*c*1 and the engaging groove 1*c*, the separation of the fitting parts 34 and 50 from the projecting part 33 and the rotary part becomes possible. In other words, the lever 26 can be operated to rotate in the direction C1 when locking the toner cartridge 7 with respect to the process unit 1, and the lever 26 can be operated to rotate in the direction C2 when unlocking the toner cartridge 7 with respect to the process unit 1.

Moreover, a rear wall 7*c* of the toner cartridge 7 provided with a handle 25 that may be held by the operator such as a user, a service person, or the like. The handle 25 is rotatably mounted with respect to the shaft 35 described above. When the operator rotates the handle 25 rearwards from a position illustrated in FIG. 3 to a position illustrated in FIG. 4, the operator can hold the handle and remove the toner cartridge 7 and the process unit 1 from the apparatus body 100. On the other hand, when the operator rotates the handle from the position illustrated in FIG. 4 back to the position illustrated in FIG. 3, the operator can return the handle 25 to an accommodating state in which the toner cartridge 7 and the process unit 1 are accommodated within the apparatus body 100.

FIG. 5 is a perspective view viewed from a lower right direction of the toner cartridge 7, and FIG. 6 is a perspective view viewed from an upper left direction of the process unit 1.

As illustrated in FIG. 5, a right end part of a front wall 7*d* of the toner cartridge 7 is provided with a toner outlet 42, and an outlet shutter 43 that opens and closes the toner outlet 42. The toner outlet 42 is an example of an opening for ejecting the toner accommodated within the toner recovery part 8.

The outlet shutter 43 is a cylindrical shutter that is formed along a curved surface in which the toner outlet 42 is provided. The toner outlet 42 is opened and closed by the outlet shutter 43 in a direction of an arrow D1 and in a direction of an arrow D2 in FIG. 5. More particularly, when the outlet shutter 43 rotates in the direction of the arrow D1, a hole (or opening) 43*a* provided in the outlet shutter reaches a position opposing the toner outlet 42, to open the toner outlet 42. On the other hand, when the outlet shutter 43 rotates in the direction of the arrow D2, the hole 43*a* reaches a position that does not oppose the toner outlet 42, to close the toner outlet 42 by a peripheral wall of the outlet shutter 43. In addition, the outlet shutter 43 is urged to rotate in the direction to close the toner outlet 42 by a torsion coil spring 27 that is an example of an urging unit (or means).

On the other hand, as illustrated in FIG. 6, the right plate 1*a* of the process unit 1 is provided with a toner inlet 44 that introduces the toner into the developing device 4, and an inlet shutter 45 that opens and closes the toner inlet 44.

The toner inlet 44 is opened and closed by sliding the inlet shutter 45 in a direction of an arrow E1 and a direction of an arrow E2 in FIG. 6. More particularly, when the inlet shutter 45 slides in the direction of the arrow E1, the inlet shutter 45 reaches a position over the toner inlet 44, to close the toner inlet 44. On the other hand, when the inlet shutter 45 slides the direction of the arrow E2, the inlet shutter 45 recedes from the position over the toner inlet 44, to open the toner inlet 44.

Moreover, as illustrated in FIG. 6, a linkage 51 is provided on an inner side of the right plate 1*a* of the process unit 1. The linkage 51 enables an operation in which the outlet shutter 43 of the toner cartridge 7 is opened and closed by the lever 26 described above. The linkage 51 includes the rotary part 52, a linear part 53 having a band shape or a linear shape, a projecting part 53*a* that is an example of an engaging part to engage a projection 43*b* provided on the outlet shutter 43 illustrated in FIG. 5.

FIG. 7 is a diagram for explaining opening and closing operations the outlet shutter 43, and FIG. 8 is a diagram for explaining the opening and closing operations of the outlet shutter 43. As illustrated in FIG. 7, when the lever 26 is rotated clockwise (that is, operated in a locking direction) as illustrated in FIG. 8 in a state in which the toner cartridge 7 is attached to the process unit 1 and the fitting part 50 is fitted over the rotary part 52, the rotary part 52 rotates in the same direction as the lever 26 as the lever 26 rotates. In this state, when the rotary part 52 rotates, the linear part 53 is pulled in a leftward direction in FIG. 7 and undergoes a linear movement. Accordingly, the projecting part 53*a* provided on the end part of the linear part 53 engages the projection 43*b* of the outlet shutter 43, and rotates the outlet 43 in an opening direction.

On the other hand, when the lever 26 is rotated counter-clockwise (that is, operated in an unlocking direction) as illustrated in FIG. 8 in a state in which the toner cartridge 7 is attached to the process unit 1 and the fitting part 50 fitted over the rotary part 52, the rotary part 52 rotates in the same direction as lever 26 as the lever 26 rotates. In this state, when the rotary part 52 rotates, the linear part 53 is pulled by a spring 56 that is an example of an urging unit (or means) and moves in a rightward direction in FIG. 7. As a result, the outlet shutter 43 is rotated by the torsion coil spring 27 to rotate in a closing direction.

FIGS. 9 and 10 are perspective views viewed from a left side of the toner cartridge 7, and FIGS. 11 and 12 are perspective views viewed from an inner side of the left plate 1*b* of the process unit 1.

As illustrated in FIG. 9, a left end part of the front wall 7*d* of the toner cartridge 7 is provided with a waste toner inlet 36, an inlet shutter 37 that opens and closes the waste toner inlet 36, and a seal 57 that is arranged in a periphery of the waste toner inlet 36. The waste toner inlet 36 is an example of an opening for introducing the waste toner into the waste toner recovery part 9.

The waste toner inlet 36 is formed to open above a curved recess 7*e* that is formed under the positioning projection 31. The inlet shutter 37 is a rotary shutter that is curved along a curved surface in which the waste toner inlet 36 is provided. When the inlet shutter 37 rotates in a direction of an arrow F1 in FIG. 10 from a state illustrated in FIG. 9, the inlet shutter 37 reaches a position over the waste toner inlet 36, to close the waste toner inlet 36. On the other hand, when the inlet shutter 37 rotates in a direction of an arrow F2 in FIG. 9 from the state illustrated in FIG. 10, the inlet shutter 37 recedes from the position over the waste toner inlet 36, to open the waste toner inlet 36. In addition, the inlet shutter 37 is urged to rotate in the direction to close the waste toner inlet 36 by a torsion coil spring 58 that is an example of an urging unit (or means).

On the other hand, as illustrated in FIG. 11, the left plate 1*b* on the inner part of the process unit 1 is provided with a waste toner outlet 38 for ejecting the waste toner removed from the photoconductor 2, and an outlet shutter 40 that opens and closes the waste toner outlet 38.

The waste toner outlet 38 is formed to open under a tip end part of a tubular waste toner transport passage 39 that projects towards an inner side from the left plate 1*b* of the process unit 1. The outlet shutter 40 a rotary shutter that is mounted on an outer periphery of the waste toner transport passage 39. When the outlet shutter 40 rotates in a direction of an arrow G1 in FIG. 12 from a state illustrated in FIG. 11, a hole (or opening) 40*a* provided in the outlet shutter 40 reaches a position opposing the waste toner outlet 38, to open the waste toner outlet 38. On the other hand, when the outlet shutter 40 rotates in a direction of an arrow G2 in FIG. 11 from the state illustrated in FIG. 12, the hole 40*a* reaches a position that does not oppose the waste toner outlet 38, to close the waste toner outlet 38 by a peripheral wall of the outlet shutter 40. In addition, the outlet shutter 40 is urged to rotate in a direction to close the waste toner outlet 38 by a torsion coil spring 59 that is an example of an urging unit (or means).

Moreover, an outer peripheral surface of the outlet shutter 40 is provided with a contact part 41 that projects in a radial direction. This contact part 41 makes contact with a wall or the inlet shutter 37 of the toner cartridge 7 when attaching the toner cartridge 7 with respect to the process unit 1, and has a function to rotate the outlet shutter 40 in an opening direction (that is, in the direction of the arrow G1 in FIG. 12). On the other hand, in the inlet shutter 37 of the toner cartridge 7 rotates in an opening direction (that is, in the direction of the arrow F2 in FIG. 9) by making contact with a wall or the outlet shutter 40 of the process unit 1 when attaching the toner cartridge 7 with respect to the process unit 1.

Accordingly, the outlet shutter 40 and the inlet shutter 37 rotate in the respective opening directions responsive to an operation to attach the toner cartridge 7 and the process unit 1, and in a state in which the attaching of the toner cartridge 7 to the process unit 1 completed, the waste toner outlet 38 and the waste toner inlet 36 communicate with each other. As a result, the waste toner removed from the surface of the photoconductor 2 can be introduced from the process unit 1 into the waste toner recovery part 9 of the toner cartridge 7.

On the other hand, when the toner cartridge 7 is detached from the process unit 1, the outlet shutter 40 and the inlet shutter 37 are released from contact with respective contacting parts, and are rotated in the respective closing directions by urging forces exerted by the respective torsion coil springs 58 and 59. Hence, leaking of the toner from the waste toner outlet 38 and the waste toner inlet 36 can be prevented.

In the configuration of this embodiment, when detaching the toner cartridge 7 from the process unit 1, the inlet shutter 37 and the outlet shutter 40 rotate in the closing direction at the same time as the detaching. However, the toner may fall from the waste toner outlet 38 and the outlet shutter 40 in this state. More particularly, as illustrated in FIG. 13 when detaching the toner cartridge 7 from the process unit 1, a toner T adhered at the waste toner outlet 38 and vicinities of the waste toner outlet 38 may fall by being scraped off by the outlet shutter 40 that rotates in the closing direction. FIG. 13 is a diagram illustrating a state in which the toner scraped off by the outlet shutter 40 that rotates falls. In addition, the toner T adhered at the waste toner outlet 38 and the outlet shutter 40 may fall due to vibration or the like at the time when the toner cartridge 7 is detached from the process unit 1. If the toner T falls into the process unit 1 or onto various devices within the image forming apparatus, the devices and peripheral parts thereof will be contaminated by the toner T, and may cause an abnormality in functions of the devices.

For this reason, as illustrated in FIG. 9, the toner 7 in this embodiment is provided with a collecting member (or collector) 80 that is configured to collect the toner falling from the waste toner outlet 38 and the outlet shutter 40 at the time when the toner cartridge 7 is detached from the process unit 1.

Next, a description will be given of a configuration of the collecting member 80. FIG. 14 is a perspective view of the collecting member 80 in a first embodiment of the present invention.

The collecting member 80 may be formed by a resilient sheet material, such as PET (Polyethylene Terephthalate) or the like, that is formed to a predetermined shape. As illustrated in FIG. 14, the collecting member 80 in this embodiment is formed by a front part 80*a* arranged vertically in up and down directions in an orientation illustrated in FIG. 14, a pair of side parts 80*b* and 80*c* extending from both sides of the front part 80*a*, and a bottom part 80*d* extending from a lower end of the front part 80*a*. The front part 80*a* extends upwards from the bottom part 80*d*. In addition, a curved part 80*e*, that is abruptly or gradually curved at a predetermined angle, is provided on an upper part of the front part 80*a*. In other words, the front part 80*a* is formed by a base part 80*a*1, and a sloping part 80*a*2 that is sloped with respect to the base part 80*a*1 via the curved part 80*e*. The base part 80*a*1 includes the pair side parts 80*b* and 80*c*, and the bottom part 80*d* that are connected.

FIG. 15 is a side view of a state in which the collecting member 80 in the first embodiment of the present invention is mounted on the toner cartridge 7.

In this embodiment, when mounting the collecting member 80 on the toning cartridge 7, the pair of side parts 80*b* and 80 *c* and the bottom part 80 *d* are mounted on a housing (or casing) of the toner cartridge 7. More particularly, the bottom part 80*d* is mounted on a top surface of a stepped part 7*g* projecting from an attaching front surface 7*i* surface facing the attaching direction B1 of the toner cartridge 7. On the other hand, the pair of side parts 80*b* and 80 *c* are mounted on attaching side surfaces 7*h* located on both sides of the attaching front surface 7*i* of the toner cartridge 7. In addition, as illustrated in FIG. 16, the bottom part 80*d* may be mounted on a front surface of the stepped part 7*g* . FIG. 16 is a diagram illustrating another method of mounting the collecting member 80. In FIGS. 15 and 16, only one of the pair of side parts 80 *b* and 80*c*, namely, the side part 80 *b*, is illustrated. However the other side part 80*c* is mounted on the attaching side surface 7*h* located on the opposite side (that is, on the back side relative to the paper surface or inwards into the paper surface) from the attaching side surface 7*h* illustrated on the front side relative to the paper surface (or outwards from the paper surface) in FIGS. 15 and 16, for example.

In a state in which the collecting member 80 is mounted on the toner cartridge 7 in the manner described above, the front part 80*a* is arranged with a gap formed between the front part 80*a* and the attaching front surface 7*i* of the toner cartridge 7. This gap between the front part 80*a* and the attaching front surface 7*i* of the toner cartridge 7 forms an accommodating part 81 that accommodates the toner collected by the collecting member 80. In other words, the accommodating part 81 is formed by a space that is surrounded by the front part 80*a*, the attaching front surface 7*i* of the toner cartridge 7 opposing the front part 80*a*, the pair of side parts 80*b* and 80*c* opposing each other, and the bottom part 80*d* (in the example illustrated in FIG. 15), or the top surface of the stepped part 7*g* (in the example illustrated in FIG. 16).

In addition, in the state in which the collecting member 80 is mounted on the toner cartridge 7, the sloping part 80*a*2 is arranged to have a slope from the curved part 80*e* towards the attaching direction B1 of the toner cartridge 7. An angle θ1 at which the sloping part 80*a*2 sloped in the attaching direction B1 with respect to an extension of the base part 80*a*1 may be appropriately determined according to the configurations of the toner cartridge 7 and the process unit 1, curved (or nonlinear) attaching and detaching paths of the toner cartridge 7 with respect to the process unit 1, or the like. The curved attaching and detaching paths of the toner cartridge 7 with respect to the process unit 1 include at least a portion where the path is curved (or nonlinear), and may include a portion where the path is linear.

Next, a description will be given of functions and effects of the collecting member 80 in the first embodiment, by referring to FIGS. 17A, 17B, 17C, and 17D.

FIG. 17A is a cross sectional view of a state in which the toner cartridge 7 is attached to the process unit 1. In this state, the front part 80*a* of the collecting member 80 is pushed against the housing of the toner cartridge 7 by the contact part 41 of the outlet shutter 40. Hence, the front part 80*a* is held between the contact part 41 of the outlet shutter 40 and housing of the toner cartridge 7 in a state in which the front part 80*a* is resiliently deformed towards the toner cartridge 7 (that is, in the detaching direction B2 opposite to the attaching direction B1 of toner cartridge 7.

When detaching the toner cartridge 7 from the process unit 1 starts as illustrated in FIG. 17B from the attached state illustrated in FIG. 17, the outlet shutter 40 and the inlet shutter 37 start to rotate in the respective closing directions. In this state, a part of the toner T adhered at the waste toner outlet 38 and the hole 40*a* in the outlet shutter 40 may be scraped off by the outlet shutter 40 that rotates in the closing direction and fall onto the housing of the toner cartridge 7.

In addition, as illustrated in FIG. 17C, when the toner cartridge 7 moves further in the detaching direction, the gap between the contact part 41 of the outlet shutter 40 and the housing of the toner cartridge 7 increases, and the front part 80*a* of the collecting member 80 is resiliently deformed so as to return to its original state before the resilient deformation due to an elastic restoration force of the front part 80*a*. As a result, a part where the front part 80*a* and the housing of the toner cartridge 7 make contact is released to open, so that the falling toner T is accommodated within the accommodating part 81 through the open part between the front part 80*a* and the housing of the toner cartridge 7. Further, in a case in which the toner T falls from the waste toner outlet 38 and the hole 40*a* in the outlet shutter 40, falling toner T is received by the front part 80*a* of the collecting member 80 and is guided into the accommodating part 81.

Thereafter, as illustrated in FIG. 17D, the collecting member 80 separates from the outlet shutter 40, and collecting member 80, including the front part 80*a* of the collecting member 80, is resiliently deformed so as to return to its original state before the resilient deformation.

According to the configuration of this embodiment described above, even if the toner falls from at least one of the waste toner outlet 38 and the outlet shutter 40 when the toner cartridge 7 is detached from the process unit 1, the collecting member 80 can receive and collect the falling toner T. More particularly, because the collecting member 80 in this embodiment returns to its original state before the resilient deformation due to the elastic restoration force thereof while making contact with the outlet shutter 40, the collecting member 80 does not immediately separate from the outlet shutter 40 when the detaching of the toner cartridge 7 from the process unit 1 starts, and the collecting member 80 can maintain contact with the outlet shutter 40 for a predetermined time after the detaching of the toner cartridge 7 from the process unit 1 starts. Accordingly, the collecting member 80 can positively receive and collect the toner T that falls with a time delay, and the toner T can be collected with a high probability.

Further, in this embodiment, the collecting member 80 is in contact with the outlet shutter 40 until the waste toner outlet 38 is completely closed by the outlet shutter 40, as illustrated in FIG. 17C. For this reason, the toner T falling from the waste toner outlet 38 can be positively collected. In addition, from a viewpoint of positively collecting the falling toner T, a width W1 of particularly the front part 80*a* of the collecting member 80 illustrated in FIG. 14 is preferably greater than a width W2 of the hole 40*a* in the outlet shutter 40 illustrated in FIG. 11.

Moreover, in this embodiment, a deformable free end of the collecting member 80 that can undergo the resilient deformation is curved towards the attaching direction of the toner cartridge 7. Consequently, a sufficiently long contact time can be secured, during which contact time the collecting member 80 makes contact with the outlet shutter 40.

Next, a description will be given of a comparison of the functions and effects for a case in which the collecting member 80 is curved as if this embodiment, and a case in which the collecting member 80 is not curved and is linearly formed.

FIGS. 18A and 18B are diagrams comparing a configuration which the collecting member 80 is curved and a configuration in which the collecting member 80 is not curved and is linearly formed. FIG. 18A illustrates the configuration in which the collecting member 80 is curved, and FIG. 18B illustrates the configuration in which the collecting member 80 is not curved and is linearly formed.

FIGS. 18A and 18B illustrate a state in which the front part 80*a* of the collecting member 80 is pushed by the contact part 41 of the outlet shutter 40 that rotates in the closing direction and is inclined at a predetermined angle. In this state, a free tip end of the collecting member 80 that is linearly formed is separated from the outlet shutter 40, as illustrated in FIG. 18B. For this reason, the falling toner T can enter between the collecting member 80 and the outlet shutter 40, and it may be difficult for the configuration illustrated in FIG. 18B to positively collect the toner T. On the other hand, the free tip end of the collecting member 80 that is curved can maintain contact with the outlet shutter 40, as illustrated in FIG. 18A, even when the collecting member 80 that is curved is inclined by approximately the same angle as the collecting member 80 that is linearly formed and is illustrated in FIG. 18B. Hence, compared to the collecting member 80 that is linearly formed, the collecting member 80 that is curved can maintain contact with the outlet shutter 40 for a sufficiently long time, thereby reducing the possibility of the toner T entering between the collecting member 80 and the outlet shutter 40. Therefore, by bending the collecting member 80 in the attaching direction of the toner cartridge 7 in FIG. 18A as in this embodiment, it becomes possible to more positively prevent the toner T from falling into the process unit 1 and into the image forming apparatus.

In the case in which the collecting member 80 is linearly formed, the collecting member 80 is still capable of receiving and collecting the falling toner T until the tip end of the collecting member 80 separates from the outlet shutter 40. In other words, the configuration illustrated in FIG. 18B is not excluded from the embodiments of the present invention in that this configuration also has the function and effect of collecting the toner T.

In this embodiment, the positioning projections 29 and 31 of the toner cartridge 7 are guided by the guide grooves 23 and 24 of the process unit 1 to determine the curved attaching and detaching paths of the toner cartridge 7 with respect to the process unit 1. For this reason, a moving path of the collecting member 80 with respect to the outlet shutter 40 when the toner cartridge 7 is detached from the process unit 1 is also determined, and a behavior of the collecting member 80 with respect of the outlet shutter 40 can be made the same each time. Accordingly, it is possible stably perform the toner collecting function.

In addition, because a moving path of collecting member 80 with respect to the outlet shutter 40 when the toner cartridge 7 is attached to the process unit 1 also determined, a contact position of the collecting member 80 with respect to the outlet shutter 40 can be made the same each time. As a result, it is possible to prevent deformation or damage to the collecting member 80 that would interfere with the toner collecting function. A behavior of the collecting member 80 when the toner cartridge 7 is attached to the process unit 1, including resilient deformation of the collecting member 80, occurs in an order opposite to that of the behavior of the collecting member 80 when the toner cartridge 7 is detached from the process unit 1 as illustrated in FIGS. 17A through 17D. For this reason, a detailed description on the behavior of the collecting member 80 when the toner cartridge 7 is attached to the process unit will be omitted.

In the embodiment described above the collecting member 80 has the function of receiving and collecting the falling toner. However, the function of the collecting member 80 is not limited to such a function, and the collecting member 80 may include a function to positively remove and collect the toner adhered on the outlet shutter 40. For example, the collecting member 80 may make sliding contact with the outlet shutter 40 responsive to the detaching of the toner cartridge 7 from the process unit 1, in order to wipe off the toner adhered on the outlet shutter 40 and collect the toner that is wiped off.

Next, a description will be given of other embodiments of the present invention. In the following other embodiments, a description of those parts that are the same as those corresponding parts of the first embodiment will be omitted, since the functions and effects of the corresponding parts are the same.

FIG. 19 is perspective view of the collecting member 80 in a second embodiment of the present invention.

In this embodiment, the collecting member 80 includes a restricting part 80*f* that extends from the carved part 80*e* in a direction opposite the sloping part 80*a*2. The restricting part 80*f* is sloped at an angle θ2 with respect to the base part 80*a*1 in a state in which the collecting member 80 is not resiliently deformed, as illustrated in FIG. 19. In the example illustrated in FIG. 19, the restricting part 80*f* is formed by adhering a separate sheet material on the sloping part 80*a*2 of the collecting member 80.

FIG. 20 is a side view of a state in which the collecting member 80 in the second embodiment is mounted on the toner cartridge 7.

As illustrated in FIG. 20, in the state in which the collecting member 80 is mounted on the toner cartridge 7, the restricting part 80*f* extends towards the housing of the toner cartridge 7 and is located above the accommodating part 81. A gap 82 is provided between a tip end of the restricting part 80*f* and the housing of the toner cartridge 7, and the waste toner is accommodated into the accommodating part 81 through this gap 82.

FIG. 21 is a diagram illustrating a state in which the toner cartridge 7 is upside-down. Because the restricting part 80*f* is provided in this second embodiment, even if the toner cartridge 7 is oriented upside-down as illustrated in FIG. 21, the restricting part 80*f* can catch toner T falling from the accommodating part 81, to thereby restrict the toner T from being ejected outside the toner cartridge 7. Furthermore, in the state illustrated in FIG. 21 in which the opening of the accommodating part 81 faces downwards, the toner T that is received by the restricting part 80*f* can be held so as not to fall, by arranging the tip end of the restricting part 80*f* to extend obliquely upwards.

FIGS. 22A, 22B, and 22C are diagrams illustrating a state in which the restricting part 80*f* undergoes a resilient deformation when attaching the toner cartridge 7 to the process unit 1.

First, as illustrated in FIG. 22A, when attaching the toner cartridge 7 to the process unit 1, the tip end of the collecting member 80, more particularly, the tip end of the sloping part 80*a*2, makes contact with the outlet shutter 40.

Next, as illustrated in FIG. 22B, as the toner cartridge 7 is moved further in the attaching direction B1, the collecting member 80 is pushed by the contact part 41 of the outlet shutter 40 and bends towards the toner cartridge 7 while undergoing a resilient deformation. In this state, the restricting part 80*f* makes contact with the housing of the toner cartridge 7, and bends so that the angle θ2 with respect to the base part 80*a*1 decreases and becomes small.

In addition, in a state in which the attaching of the toner cartridge 7 with respect to the process unit 1 is completed as illustrated in FIG. 22C, the restricting part 80*f* is pinched between the base part 80*a*1 and the housing of the toner cartridge 7, and is maintained in the bent state.

A behavior of the restricting part 80*f* when detaching the toner cartridge 7 from the process unit 1 is in reverse to the behavior of the restricting part 80*f* when attaching the toner cartridge 7 to the process unit 1. In other words, when moving the toner cartridge 7 to detach the toner cartridge 7 from the process unit 1, the angle θ2 of the restricting part 80*f* with respect to the base part 80*a*1 increases, and an elastic restoration force of the restricting part 80*f* returns the restricting part 80*f* to its original state.

Moreover, as illustrated in FIG. 23, when the collecting member 80 is resiliently deformed by being pushed by the contact part 41 of the outlet shutter 40, a contact angle θ3 at which the tip end of the restricting part 80*f* makes contact with the housing of the toner cartridge 7 is preferably less than 90°. FIG. 23 is a diagram illustrating the angle at which the tip end of the restricting part 80*f* makes contact with the housing of the toner cartridge 7. The contact angle θ3 refers to an angle formed between a surface α of the restricting part 80*f*, located on the side of the restricting part 80*f* that moves towards the toner cartridge 7 when attaching the toner cartridge 7 to the process unit 1, and a tangent γ with respect to the housing of the toner cartridge 7 at a contact point β where the tip end of the restricting part 80*f* and the housing of the toner cartridge 7 make contact.

By setting the contact angle θ3 to less than 90°, when resiliently deforming the collecting member 80, the restricting part 80*f* can more easily be deformed so that the angle θ2 with respect to the base part 80*a*1 becomes small. Hence, it is possible to prevent the restricting part 80*f* from becoming deformed so that the angle θ2 increases and becomes large, and prevent a plastic deformation of the restricting part 80*f* that would deteriorate the function of the collecting member 80.

FIG. 24 is a perspective view of the collecting member 80 in a third embodiment of present invention.

In this third embodiment, restricting parts 80*g* and 80*h* are additionally provided on the collecting member 80 at upper parts of the side parts 80*b* and 80*c*, respectively, in addition to the configuration of the second embodiment described above. For the sake of convenience in the following description, the restricting part 80*f* provided on the front part 80*a* may also be referred to as a "first restricting part", and each of the restricting parts 80*g* and 80*h* provided on the upper parts of the side parts 80*b* and 80*c*, respectively, may be referred to as "second restricting parts".

The second restricting parts 80*g* and 80*h* may be formed by a resilient material, such as a sponge or the like. The second restricting parts 80*g* and 80*h* are formed to a rectangular parallelepiped shape or a cubic shape, for example, so that the second restricting parts 80*g* and 80*h* contact two sides that are at right angles and are formed by the front part 80*a* and the side parts 80*b* and 80*c*, respectively.

FIG. 25 is a side view of a state in which the collecting member 80 in the third embodiment is mounted on the toner cartridge 7.

As illustrated in FIG. 25, in a state in which the collecting member 80 is mounted on the toner cartridge 7, the second restricting parts 80*g* and 80*h* are arranged above the accommodating part 81. In addition, the second restricting parts 80*g* and 80*h* are arranged to respectively make contact with an attaching front surface 7*i* of the toner cartridge 7, so as not to generate a gap between the attaching front surface 7*i* and the second restricting parts 80*g* and 80*h*.

In this third embodiment, because the second restricting parts 80*g* and 80*h* are provided in this third embodiment, even if the toner cartridge 7 is tilted in one of the right and left directions as illustrated in FIG. 26, for example, one of the second restricting parts 80*g* and 80*h* (the second restricting part 80*g* in the state illustrated in FIG. 26) can catch the toner T falling from the accommodating part 81, to thereby restrict the toner T from being ejected outside the toner cartridge 7. FIG. 26 is a diagram illustrating a state in which the toner cartridge 7 is tilted in one of the right and left directions. Accordingly, it becomes possible to positively prevent the toner T from being ejected from the accommodating part 81 to the outside of the toner cartridge 7. Although both the first restricting part 80*f* and the second restricting parts 80*g* and 80*h* are provided in the collecting member 80 of this example, it is possible to omit the first restricting part 80*f* and provide only the second restricting parts 80*g* and 80*h* in the collecting member 80.

FIG. 27 is a diagram illustrating a state in which the second restricting parts 80*g* and 80*h* undergo a compressive deformation when attaching the toner cartridge 7 to the process unit 1. Because the second restricting parts 80*g* and 8*h* may be formed by the resilient material, the second restricting parts 80*g* and 80*h* can undergo a resilient deformation when the toner cartridge 7 is attached to the process unit 1. More particularly, as illustrated in FIG. 27, the second restricting parts 80*g* and 80*h* can undergo a compressive deformation by being pinched between the housing of the toner cartridge 7 and the base part 80*a*1 of the collecting member 80 that is resiliently deformed. Hence, the collecting member 80 can bend to a predetermined orientation when attaching the toner cartridge 7 to the process unit 1.

FIG. 28 is a diagram illustrating a configuration of a fourth embodiment of the present invention.

In this fourth embodiment, a third restricting part 80*i* is additionally arranged under the first restricting part 80*f*. The third restricting part 80*i* is provided to extend from the attaching front surface 7*i* of the toner cartridge 7, is a direction opposite to the first restricting part 80*f*.

By arranging the plurality of restricting parts 80*f* and 80*i* that extend in mutually different directions at a spacing along the up-and-down direction, it becomes possible to accurately restrict the toner from ejecting out from the accommodating part 81 in a case in which the toner cartridge 7 is orientated upside-down. In addition, a tip end of the third restricting part 80*i* is arranged with a gap 83 with respect to the opposing base part 80*a*1 of the collecting member 80, so that the waste toner can be accommodated into the accommodating part 81 through the gap 83.

The present invention is not limited to these embodiments, and various variations, modifications and substitutions may be made without departing from the scope of the present invention.

In the described embodiments, the collecting member 80 is provided on the toner cartridge 7 that is detachably provided with respect to the process unit 1. However, the present invention is similarly applicable to various units that are detachably provided with respect to an other unit that is provided with an opening through which image forming powder is ejected or received, and a shutter that is configured to open and close the opening.

For example, depending on a configuration of a part that exchanges the image forming powder, such as the toner, the collecting member may be provided on the process unit.

The unit that is detachably provided with respect to the other unit, and the other unit are not limited to units that are detachable with respect to the apparatus body, and may also include a base unit or the like of the image forming apparatus. Accordingly, the collecting member may be provided on the apparatus body.

In addition, the location where the collecting member is provided is not limited to a location where the waste toner is exchanged, and may also be provided at a location where the unused toner is exchanged. Furthermore, the image forming powder used in the present invention may be a single-component developer consisting solely of the toner, or may be a two-component developer including the toner and a carrier.

The image forming apparatus to the present invention may be applied is not limited to the monochrome image forming apparatus illustrated in FIG. 1. For example, the present invention may be applied to a color image forming apparatus employing an indirect transfer system illustrated in FIG. 29, a color image forming apparatus employing a direct transfer system illustrated in FIG. 30, or the like. FIG. 29 is a diagram schematically illustrating a configuration of the color image forming apparatus employing the indirect transfer system, and FIG. 30 is a diagram schematically illustrating a configuration of the color image forming apparatus employing the direct transfer system. As illustrated in FIG. 29, the color image forming apparatus employing the indirect transfer system indirectly transfers images on a plurality of photoconductors 2 onto the sheet via an intermediate transfer belt (or an intermediate transfer body) 60. On the other hand, as illustrated in FIG. 30, the color image forming apparatus employing the direct transfer system directly transfers the images on the plurality of photoconductors 2 onto the sheet P that is transported by a transport belt (or transport body) 61. The image forming apparatuses to which the present invention may be applied include as copying apparatuses, printers, facsimile apparatuses, MFPs (Multi-Function Peripherals), or the like.

The following aspects (A1)-(A15) also fall within the scope of the present invention.

(A1). A toner container (7) detachably attachable to an image forming device (1) that includes an opening (42) through which waste toner (T) is supplied from the image forming device and a shutter (43) to open and close the opening, the toner container comprising:

a part (29, 31) that is detachably attachable relative to the image forming device (1); and a collector (80) that collects waste toner falling from at least one of the opening and the shutter by making contact with the shutter when detaching the toner container from the image forming device.

(A2). The toner container (7) according to aspect (A1), wherein the collector (80) is made of a resilient material, wherein the collector, when attaching the toner container to the image forming device (1), makes contact with the shutter (43) and is resiliently deformed in a direction opposite to a direction in which the toner container is attached to the image forming device, and wherein the collector, when detaching the toner container from the image forming device, is resiliently deformed while making contact with the shutter so as to return to its original state before the resilient deformation due to an elastic restoration force of the collector.

(A3). The toner container (7) according to aspect (A2), wherein a free tip end of the collector (80) is curved towards the direction in which the toner container is attached to the image forming device (1) and is resiliently deformable.

(A4). The toner container (7) according to aspect (A2) or (A3), wherein the collector (80) makes contact with the shutter (43) until the opening (42) is completely closed by the shutter, when detaching the toner container from the image forming device (1).

(A5). The toner container (7) according to any of aspects (A1) to (A4), wherein the collector (80) includes an accommodating part (81) that accommodates the waste toner (T) that is collected by the collector.

(A6). The toner container (7) according to aspect (A5), further comprising:

an attaching front surface (7*i*) facing the direction in which the toner container is attached to the image forming device (1);

a pair of attaching side surfaces (7*h*) provided on both sides of the attaching front surface; and a stepped part (7*g*) projecting from the attaching front surface, wherein the collector (80) further includes a bottom part (80d) mounted on a front surface or a top surface of the stepped part, A front part (80a) extending upwards from the bottom part, and arranged with a gap formed between the front part and the attaching front surface, and a pair of side parts (80b, 80c) extending from both sides of the front part, and mounted on the pair of attaching side surfaces.

wherein the accommodating part is formed by a space that is surrounded by the front part, the attaching front surface opposing the front part, the pair of side parts opposing each other, and the bottom part or the top surface of the stepped part.

(A7). The toner container (7) according to aspect (A5) or (A6), wherein the collector (80) includes a restricting part (80*f*, 80*g*, 8*h*, 80*i*) that is the waste toner (T) from being ejected outside the toner container from the accommodating part (81).

(A8). The toner container (7) according to aspect (A6), wherein the collector (80) includes a restricting member (80*f*) that restricts the waste toner (T) from being ejected outside the toner container from the accommodating part (81) and wherein the restricting part extends above the accommodating part, and is sloped at an angle with respect to the front part.

(A9). The toner container (7) according to aspect (A8), wherein the restricting part (80*f*), when attaching the toner container to the image forming device (1), is deformed so that the angle decreases by making contact with the image forming device.

(A10). The toner container (7) according to aspect (A9), wherein a tip end of the restricting part (80*f*), when attaching the toner container to the image forming device (1), makes contact with the image forming device at a contact angle of less than 90°.

(A11). The toner container (7) according to any of aspects (A8) to (A10), wherein the tip end of the restricting part (80*f*) forms a gap between the tip end and the image forming device (1).

(A12). The toner container (7) according to any of aspects (A7) to (A11), wherein the restricting part (80*g*, 80*h*) is provided on the pair of side parts above the accommodating part (81).

(A13). The toner container (7) according to aspect (A12), wherein the restricting part (80*f*, 80*g*, 80*h*) is made of a resilient material, and wherein the restricting part, when attaching the toner container to the image forming device (1), undergoes a compressive deformation by being pinched between the image forming device and the front part that is resiliently deformed.

(A14). The toner container (7) according to any of aspects (A1) to (A13), wherein the toner container is attached to and detached from the image forming device (1) via curved attaching and detaching paths.

(A15). An image forming apparatus comprising;

the toner container (7) according to any of aspects (A1) to (A14) ; and the image forming device (1).

This application claims the benefit of a Japanese Patent Application No. 2014-208010 filed on Oct. 9, 2014, in the Japanese Patent Office, the disclosure of which is hereby incorporated by reference.

REFERENCE SIGNS LIST

1 Process Unit
1*a* Right Plate
1*b* Left Plate
2 Photoconductor
3 Roller
4 Developing Device
5 Cleaning Blade
6 LED Head Array
7 Toner Cartridge
7*g* Stepped Part
7*h* Attaching Side Surface
7*i* Attaching Front Surface
8 Toner Recovery Part
9 Waste Toner Recovery Part
10 Transfer Device
11 Sheet Feeding Device
12 Fixing Device
13 Sheet Ejection Device
14 Transfer Roller
15 Feeding Cassette
16 Sheet Feeding Roller
17 Registration Roller
18 Fixing Roller
19 Pressing Roller
20 Sheet Ejection Roller
21 Sheet Ejection Tray
23 Guide Groove
24 Guide Groove
25 Handle
26 Lever
26*c*1 Locking Projection
27 Torsion Coil Spring

28 Positioning Projection
30 End
31 Positioning Projection
32 End
33 Projecting Part
34 Fitting Part
34*a* Recess
35 Shaft
36 Waste Toner Inlet
37 Inlet Shutter
38 Toner Outlet
39 Toner Transport Passage
40 Outlet Shutter
40*a* Hole (Opening)
41 Contact Part
42 Opening
43 Outlet Shutter
44 Toner Inlet
45 Inlet Shutter
50 Fitting Part
50*a* Recess
51 Linker
52 Rotary Part
53 Linear Part
53*a* Projecting Part
56 Spring
57 Seal
58 Torsion Coil Spring
59 Torsion Coil Spring
60 Intermediate Transfer Belt
61 Transport Belt
80 Collecting Member
80*a* Front Part
80*b* Side Part
80*c* Side Part
80*d* Bottom Part
80*e* Curved Part
80*f* Restricting Part (First Restricting Part)
80*g* Restricting Part (Second Restricting Part)
80*h* Restricting Part (Second Restricting Part)
80*i* Restricting Part (Third Restricting Part)
81 Accommodating Part
82 Gap
83 Gap
θ2 Angle
θ3 Angle
T Toner

The invention claimed is:

1. A unit comprising:

a part that is detachably attachable relative to an other unit, wherein the other unit includes an opening through which image forming powder is supplied from or received by the other unit, and a shutter configured to open and close the opening; and a collecting member configured to collect the image forming powder falling from at least one of the opening and the shutter by making contact with the shutter when detaching the unit from the other unit, wherein the collecting member is resiliently deformed out of its original state to make contact with the shutter when attaching the unit to the other unit.

2. The unit as claimed in claim 1, wherein the collecting member is made of a resilient material, wherein the collecting member, when attaching the unit to the other unit, is resiliently deformed in a direction opposite to a direction in which the unit is attached to the other unit, and wherein the collecting member, when detaching the unit from the other unit, is resiliently deformed while making contact with the shutter so as to return to its original state before the resilient deformation due to an elastic restoration force of the collecting member.

3. The unit as claimed in claim 2, wherein a free tip end of the collecting member is curved towards the direction in which the unit is attached to the other unit and is resiliently deformable.

4. The unit as claimed in claim 2, wherein the collecting member makes contact with the shutter until the opening is completely closed by the shutter, when detaching the unit from the other unit.

5. The unit as claimed in claim 1, wherein the collecting member includes an accommodating part configured to accommodate the image forming powder that is collected by the collecting member.

6. The unit as claimed in claim 5, further comprising:

an attaching front surface facing a direction in which the unit is attached to the other unit;

a pair of attaching side surfaces provided on both sides of the attaching front surface; and a stepped part projecting from the attaching front surface, wherein the collecting member further includes:

a bottom part mounted on a front surface or a top surface of the stepped part, a front part extending upwards from the bottom part, and arranged with a gap formed between the front part and the attaching front surface, and a pair of side parts extending from both sides of the front part, and mounted on the pair of attaching side surfaces, wherein the accommodating part is formed by a space that is surrounded by the front part, the attaching front surface opposing the front part, the pair of side parts opposing each other, and the bottom part or the top surface of the stepped part.

7. The unit as claimed in claim 6, wherein the collecting member includes a restricting member configured to restrict the image forming powder from being ejected outside the unit from the accommodating part, and wherein the restricting part extends above the accommodating part, and is sloped at a angle with respect to the front part.

8. The unit as claimed in claim 7, wherein the restricting part, when attaching the unit to the other unit, is deformed so that the angle decreases by making contact with the other unit.

9. The unit as claimed in claim 8, wherein a tip end of the restricting part, when attaching the unit to the other unit, makes contact with the other unit at a contact angle of less than 90°.

10. The unit as claimed in claim 7, wherein a tip end of the restricting part forms a gap between the tip end and the other unit.

11. The unit as claimed in claim 5, wherein the collecting member includes a restricting part configured to restrict the image forming powder from being ejected outside the unit from the accommodating part.

12. The unit as claimed in claim 11, wherein the restricting part is provided on a pair of side parts above the accommodating part.

13. The unit as claimed in claim 12, wherein the restricting part is made of a resilient material, and wherein the restricting part, when attaching the unit to the other unit, undergoes a compressive deformation by being pinched between the other unit and a front part that is resiliently deformed.

14. The unit as claimed in claim 1, wherein the unit is attached to and detached from the other unit via curved attaching and detaching paths.

15. An image forming apparatus comprising:

the unit as claimed in claim 1; and the other unit.

16. A unit comprising:

a part that is detachably attachable relative to an other unit, wherein the other unit includes an opening through which image forming powder is supplied from or received by the other unit, and a shutter configured to open and close the opening;

a collecting member configured to collect the image forming powder falling from at least one of the opening and the shutter by making contact with the shutter when detaching the unit from the other unit, an attaching front surface facing a direction in which the unit is attached to the other unit;

a pair of attaching side surfaces provided on both sides of the attaching front surface; and a stepped part projecting from the attaching front surface, wherein the collecting member includes an accommodating part configured to accommodate the image forming powder that is collected by the collecting member, wherein the collecting member further includes:

a bottom part mounted on a front surface or a top surface of the stepped part, a front part extending upwards from the bottom part, and arranged with a gap formed between the front part and the attaching front surface, and a pair of side parts extending from both sides of the front part, and mounted on the pair of attaching side surfaces, and wherein the accommodating part is formed by a space that is surrounded by the front part, the attaching front surface opposing the front part, the pair of side parts opposing each other, and the bottom part or the top surface of the stepped part.

17. The unit as claimed in claim 16, wherein the collecting member includes a restricting member configured to restrict the image forming powder from being ejected outside the unit from the accommodating part, and wherein the restricting part extends above the accommodating part, and is sloped at an angle with respect to the front part.

18. The unit as claimed in claim 17, wherein the restricting part, when attaching the unit to the other unit, is deformed so that the angle decreases by making contact with the other unit.

19. A unit comprising:

a part that is detachably attachable relative to an other unit, wherein the other unit includes an opening through which image forming powder is supplied from or received by the other unit, and a shutter configured to open and close the opening; and a collecting member configured to collect the image forming powder falling from at least one of the opening and the shutter by making contact with the shutter when detaching the unit from the other unit, wherein the collecting member includes an accommodating part configured to accommodate the image forming powder that is collected by the collecting member, and wherein the collecting member includes a restricting part configured to restrict the image forming powder from being ejected outside the unit from the accommodating part.

20. The unit as claimed in claim 19, wherein the restricting part is provided on a pair of side parts above the accommodating part.

* * * * *